US011071178B2

(12) United States Patent
Xiong et al.

(10) Patent No.: US 11,071,178 B2
(45) Date of Patent: Jul. 20, 2021

(54) LED LIGHTING SYSTEM, APPARATUS, AND DIMMING METHOD

(71) Applicant: JIAXING SUPER LIGHTING ELECTRIC APPLIANCE CO., LTD, Jiaxing (CN)

(72) Inventors: Aiming Xiong, Jiaxing (CN); Lin Zhou, Jiaxing (CN)

(73) Assignee: Jiaxing Super Lighting Electric Appliance Co., Ltd., Jiaxing (CN)

( * ) Notice: Subject to any disclaimer, the term of this patent is extended or adjusted under 35 U.S.C. 154(b) by 0 days.

(21) Appl. No.: 16/681,019

(22) Filed: Nov. 12, 2019

(65) Prior Publication Data

US 2020/0100348 A1 Mar. 26, 2020

Related U.S. Application Data

(63) Continuation-in-part of application No. 16/511,575, filed on Jul. 15, 2019.

(30) Foreign Application Priority Data

Jul. 16, 2018 (CN) ..... 201810777596.4
Nov. 13, 2018 (CN) ..... 201811347102.5
Jul. 11, 2019 (CN) ..... 201921080528.9

(51) Int. Cl.
*H05B 45/10* (2020.01)
*H05B 45/20* (2020.01)
*H05B 45/3725* (2020.01)

(52) U.S. Cl.
CPC ..... *H05B 45/10* (2020.01); *H05B 45/20* (2020.01); *H05B 45/3725* (2020.01)

(58) Field of Classification Search
CPC ..... H05B 33/0815; H05B 33/0818; H05B 41/2828; H05B 41/3921; H05B 41/3927;
(Continued)

(56) References Cited

U.S. PATENT DOCUMENTS 6,459,919 B1 * 10/2002 Lys ..... G09G 3/2014 600/407
7,889,051 B1 * 2/2011 Billig ..... H04L 61/2038 340/5.23

(Continued)

FOREIGN PATENT DOCUMENTS

CN 103369802 A 10/2013
CN 103561503 A 2/2014

(Continued)

*Primary Examiner* — Minh D A
(74) *Attorney, Agent, or Firm* — Muir Patent Law, PLLC

(57) ABSTRACT

The present invention provides an LED lamp, a control method and a control apparatus thereof, and an LED lamp system, each of which may achieve the function of light dimming in a current LED lamp without having to modify its original structure(s) wherein the current LED lamp originally could not have the function, or may achieve better dimming control of parallel-connected LED lamps. A method of controlling an LED lamp includes combining or synthesizing a power signal and a dimming instruction to produce an output signal, wherein the power signal comprises a constant DC, and the dimming instruction includes a control code comprising a specific sequence of high/low voltage levels for providing a manner of controlling the LED lamp. The LED lamp receives the output signal and performs control of itself according to the manner of controlling provided by the control code.

12 Claims, 16 Drawing Sheets

(58) Field of Classification Search
CPC .. H05B 41/28; H05B 37/029; H05B 33/0803; H05B 37/0254; H05B 37/02; G11B 7/1381; G11B 7/1384; G11B 7/1353; G11B 7/131; G11B 7/133; G11B 7/1365; G11B 7/124; G11B 7/0901; G11B 7/0908
See application file for complete search history.

(56) References Cited

U.S. PATENT DOCUMENTS

| | | | | |
|---|---|---|---|---|
| 9,084,319 | B2 | 7/2015 | Sullivan et al. | |
| 9,131,581 | B1 | 9/2015 | Hsia et al. | |
| 9,144,127 | B1 | 9/2015 | Yu et al. | |
| 9,161,401 | B1 | 10/2015 | Melanson et al. | |
| 9,161,415 | B2 | 10/2015 | Catalano et al. | |
| 9,185,767 | B2 | 11/2015 | Zanbaghi et al. | |
| 9,192,012 | B2 | 11/2015 | Trinschek et al. | |
| 9,198,250 | B2 | 11/2015 | Malyna et al. | |
| 9,210,757 | B2 | 12/2015 | Tao et al. | |
| 9,220,150 | B2 | 12/2015 | Hartmann et al. | |
| 9,258,864 | B2 | 2/2016 | Pederson et al. | |
| 9,265,112 | B2 | 2/2016 | Pederson et al. | |
| 9,265,119 | B2 | 2/2016 | Catalano et al. | |
| 9,307,619 | B2 | 4/2016 | Campbell | |
| 9,468,067 | B2 | 10/2016 | Olariu | |
| 9,544,969 | B2 | 1/2017 | Baddela et al. | |
| 10,051,714 | B2 | 8/2018 | Pederson | |
| 10,111,298 | B2 | 10/2018 | Mezack et al. | |
| 10,251,243 | B2 | 4/2019 | Pederson | |
| 10,292,227 | B1 | 5/2019 | Moumen | |
| 10,324,250 | B2 | 6/2019 | Krames et al. | |
| 2010/0259185 | A1 | 10/2010 | Sadwick et al. | |
| 2011/0133655 | A1* | 6/2011 | Recker | H05B 45/10 315/159 |
| 2011/0275432 | A1* | 11/2011 | Lutnick | G07F 17/3232 463/25 |
| 2012/0080944 | A1* | 4/2012 | Recker | H05B 45/37 307/25 |
| 2013/0141010 | A1* | 6/2013 | Reed | H05B 45/14 315/294 |
| 2014/0103810 | A1* | 4/2014 | Shaffer, II | H05B 45/58 315/114 |
| 2014/0128941 | A1* | 5/2014 | Williams | H05B 45/46 607/88 |
| 2015/0216002 | A1 | 7/2015 | Melanson et al. | |
| 2015/0237694 | A1 | 8/2015 | Zudrell-Koch | |
| 2015/0237695 | A1 | 8/2015 | Jelaca | |
| 2015/0237698 | A1 | 8/2015 | Takahashi et al. | |
| 2016/0330808 | A1 | 11/2016 | Brandt | |
| 2017/0223794 | A1 | 8/2017 | Lewis et al. | |

FOREIGN PATENT DOCUMENTS

| | | | |
|---|---|---|---|
| CN | 204350401 | U | 5/2015 |
| CN | 103561503 | B | 7/2015 |
| CN | 105191499 | A | 12/2015 |
| CN | 105873269 | A | 8/2016 |
| CN | 103945600 | B | 9/2017 |
| CN | 107148804 | A | 9/2017 |
| CN | 104582059 | B | 10/2017 |
| CN | 103687154 | B | 11/2017 |
| CN | 104540287 | B | 11/2017 |
| CN | 105554953 | B | 11/2017 |
| CN | 107409448 | A | 11/2017 |
| CN | 206743585 | U | 12/2017 |
| CN | 206807830 | U | 12/2017 |
| CN | 104869690 | B | 3/2018 |

* cited by examiner

WF4

WF5

Lux=Lmax

WF6

Lux=Lmin

WF4

WF7

Lux=Lmin

WF8

Lux=Lmax

NEW SHEET

NEW SHEET

NEW SHEET

NEW SHEET

LED LIGHTING SYSTEM, APPARATUS, AND DIMMING METHOD

RELATED APPLICATIONS

This application is a continuation-in-part application of U.S. patent application Ser. No. 16/511,575, filed Jul. 15, 2019, the contents of which are incorporated herein in their entirety, and which claims priority to and incorporates by reference in its entirety Chinese Patent Application No. CN 201810777596.4, filed on Jul. 16, 2018, and Chinese Patent Application No. CN 20191080528.9, filed on Jul. 11, 2019. This Application also claims priority to and incorporates by reference in its entirety Chinese Patent Application No. CN 201811347102.5, filed on Nov. 13, 2018.

TECHNICAL FIELD

The disclosed embodiments relate to the features of light emitting diode (LED) lighting. More particularly, the disclosed embodiments describe various improvements for LED lighting systems, an LED lighting apparatus, and LED dimming method thereof.

BACKGROUND

LED lighting technology is rapidly developing to replace traditional incandescent and fluorescent lighting. LED tube lamps are mercury-free in comparison with fluorescent tube lamps that need to be filled with inert gas and mercury. Thus, it is not surprising that various types of LED lamp, such as an LED tube lamp, an LED bulb lamp, an LED filament lamp, a high power LED lamp, an integral LED lamp, etc., are becoming a highly desired illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption. Therefore, when taking into account all factors, they would typically be considered as a cost effective lighting option.

In common solutions for LED lighting, an issue that has been widely discussed is about how to achieve dimming control of the luminance of an LED lamp. In current dimming techniques, a common way is to perform phase cutting to adjust the effective value, i.e., root-mean-square (RMS) value, of an input voltage for an LED lamp, in order to achieve the dimming effects. However, because such a common way of dimming control typically significantly affects or interferes with the completeness or accuracy of the waveform of the modulated input voltage, such a common way may inevitably cause problems such as lowered lighting efficiency or light-flickering of the LED lamp under this way of dimming control.

In view of above mentioned issues, an invention is disclosed herein and illustrated by its disclosed embodiments.

SUMMARY

It's specially noted that the present disclosure may actually include one or more inventions claimed currently or not yet claimed, and for avoiding confusion due to unnecessarily distinguishing between those possible inventions at the stage of preparing the specification, the possible plurality of inventions herein may be collectively referred to as "the (present) invention" herein.

Various embodiments are summarized in this section, and may be described with respect to the "present invention," which terminology is used to describe certain presently disclosed embodiments, whether claimed or not, and is not necessarily an exhaustive description of all possible embodiments, but rather is merely a summary of certain embodiments. Certain of the embodiments described below as various aspects of the "present invention" can be combined in different manners to form an LED lighting system, LED lighting apparatus, or a portion thereof.

According to certain embodiments, a method of controlling an LED lamp is provided. The method includes the follow steps: processing (as by combining or synthesizing) a power signal and a dimming instruction to produce an output signal, wherein the power signal comprises a constant direct current (DC), and the dimming instruction includes a control code comprising a square wave of a specific sequence of high/low voltage levels for providing a manner of controlling the LED lamp; and the LED lamp receives the output signal and performs control of itself according to the manner of controlling provided by the control code in the output signal.

According to certain embodiments, a dimmer including a dimming signal generating module and a signal combining processing module is provided. The dimming signal generating module is configured to receive a dimming instruction including a control code, which comprises a square wave of a specific sequence of high/low voltage levels for providing a manner of controlling an LED lamp, for the LED lamp to perform control of itself according to the manner of controlling provided by the control code in a received output signal such as described above. And the signal combining processing module is configured to process (as by combining or synthesizing) a power signal and the dimming instruction to produce the output signal, wherein the power signal comprises a constant direct current (DC).

According to certain embodiments, an LED lamp including or having a dimmer as described above and configured therein is provided.

According to certain embodiments, an LED lamp system including a dimmer as described above and a plurality of LED lamps is provided.

Benefits or advantages resulting from the disclosed way (s) of dimming control herein may include a benefit that dimming control is achieved while maintaining or not hindering power conversion efficiency of the LED lighting apparatus.

DETAILED DESCRIPTION

Figure 1A:
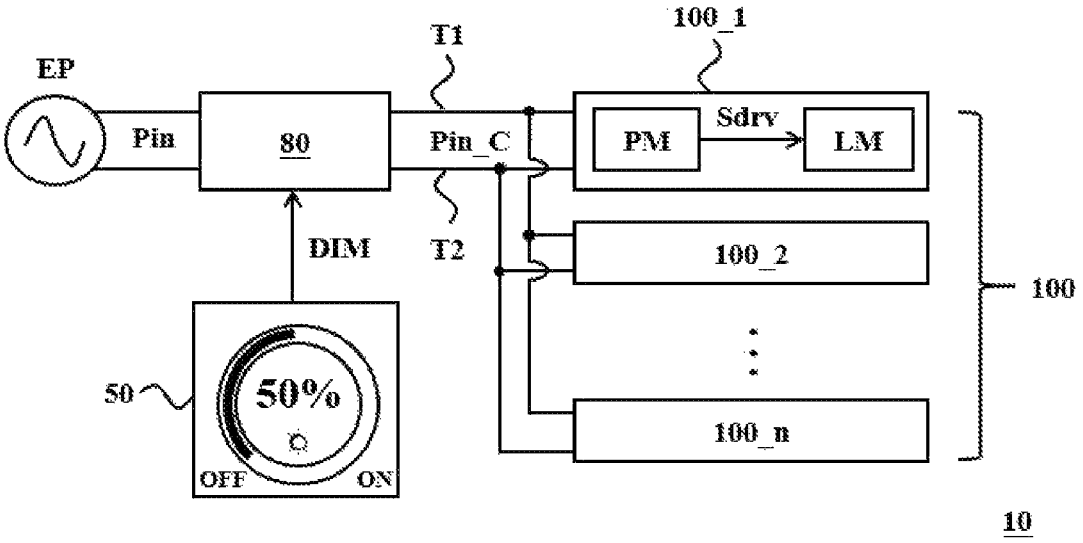
FIG. 1A is a block diagram of an LED lighting system according to an embodiment of the disclosure.

The present disclosure provides a novel LED lighting system, an LED lighting apparatus, and a dimming control method related thereto. The present disclosure will now be described in the following embodiments with reference to the drawings. The following descriptions of various embodiments of this invention are presented herein for purpose of illustration and giving examples only. It is not intended to be exhaustive or to be limited to the precise form disclosed. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

In the drawings, the size and relative sizes of components may be exaggerated for clarity. Like numbers refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/".

It will be understood that, although the terms first, second, third etc. may be used herein to describe various elements, components, regions, layers, or steps, these elements, components, regions, layers, and/or steps should not be limited by these terms. Unless the context indicates otherwise, these terms are only used to distinguish one element, component, region, layer, or step from another element, component, region, or step, for example as a naming convention. Thus, a first element, component, region, layer, or step discussed below in one section of the specification could be termed a second element, component, region, layer, or step in another section of the specification or in the claims without departing from the teachings of the present invention. In addition, in certain cases, even if a term is not described using "first," "second," etc., in the specification, it may still be referred to as "first" or "second" in a claim in order to distinguish different claimed elements from each other.

It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct connection (i.e., touching) unless the context indicates otherwise.

Embodiments described herein will be described referring to plan views and/or cross-sectional views by way of ideal schematic views. Accordingly, the exemplary views may be modified depending on manufacturing technologies and/or tolerances. Therefore, the disclosed embodiments are not limited to those shown in the views, but include modifications in configuration formed on the basis of manufacturing processes. Therefore, regions exemplified in figures may have schematic properties, and shapes of regions shown in figures may exemplify specific shapes of regions of elements to which aspects of the invention are not limited.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

Terms such as "same," "equal," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to emphasize this meaning, unless the context or other statements indicate otherwise. For example, items described as "substantially the same," "substantially equal," or "substantially planar," may be exactly the same, equal, or planar, or may be the same, equal, or planar within acceptable variations that may occur, for example, due to manufacturing processes.

Terms such as "about" or "approximately" may reflect sizes, orientations, or layouts that vary only in a small relative manner, and/or in a way that does not significantly alter the operation, functionality, or structure of certain elements. For example, a range from "about 0.1 to about 1" may encompass a range such as a 0%-5% deviation around 0.1 and a 0% to 5% deviation around 1, especially if such deviation maintains the same effect as the listed range.

Terms such as "transistor", used herein may include, for example, a field-effect transistor (FET) of any appropriate type such as N-type metal-oxide-semiconductor field-effect transistor (MOSFET), P-type MOSFET, GaN FET, SiC FET, bipolar junction transistor (BJT), Darlington BJT, heterojunction bipolar transistor (HBT), etc.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

As used herein, items described as being "electrically connected" are configured such that an electrical signal can be passed from one item to the other. Therefore, a passive electrically conductive component (e.g., a wire, pad, internal electrical line, etc.) physically connected to a passive electrically insulative component (e.g., a prepreg layer of a printed circuit board, an electrically insulative adhesive connecting two devices, an electrically insulative underfill or mold layer, etc.) is not electrically connected to that component. Moreover, items that are "directly electrically connected," to each other are electrically connected through one or more passive elements, such as, for example, wires, pads, internal electrical lines, etc. As such, directly electrically connected components do not include components electrically connected through active elements, such as transistors or diodes, or through capacitors. Directly electrically connected elements may be directly physically connected and directly electrically connected.

Components described as thermally connected or in thermal communication are arranged such that heat will follow a path between the components to allow the heat to transfer from the first component to the second component. Simply because two components are part of the same device or board does not make them thermally connected. In general, components which are heat-conductive and directly connected to other heat-conductive or heat-generating components (or connected to those components through intermediate heat-conductive components or in such close proximity as to permit a substantial transfer of heat) will be described as thermally connected to those components, or in thermal communication with those components. On the contrary, two components with heat-insulative materials therebetween, which materials significantly prevent heat transfer between the two components, or only allow for incidental heat transfer, are not described as thermally connected or in thermal communication with each other. The terms "heat-conductive" or "thermally-conductive" do not apply to any material that provides incidental heat conduction, but are intended to refer to materials that are typically known as good heat conductors or known to have utility for transferring heat, or components having similar heat conducting properties as those materials.

Embodiments may be described, and illustrated in the drawings, in terms of functional blocks, units and/or modules. Those skilled in the art will appreciate that these blocks, units and/or modules are physically implemented by electronic (or optical) circuits such as logic circuits, discrete components, analog circuits, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules. Further, the blocks, units and/or modules of the various embodiments may be physically combined into more complex blocks, units and/or modules.

If any terms in this application conflict with terms used in any application(s) from which this application claims priority, or terms incorporated by reference into this application or the application(s) from which this application claims priority, a construction based on the terms as used or defined in this application should be applied.

It should be noted that, the following description of various embodiments of the present disclosure is described herein in order to clearly illustrate the inventive features of the present disclosure. However, it is not intended that various embodiments can only be implemented alone. Rather, it is contemplated that various of the different embodiments can be and are intended to be used together in a final product, and can be combined in various ways to achieve various final products. Thus, people having ordinary skill in the art may combine the possible embodiments together or replace the components/modules between the different embodiments according to design requirements. The embodiments taught herein are not limited to the form described in the following examples, any possible replacement and arrangement between the various embodiments are included.

FIG. 1A is a block diagram of an LED lighting system according to an embodiment of the disclosure. Referring to FIG. 1A, the LED lighting system 10 includes a dimmer 80 and an LED lighting apparatus 100 including a power supply module PM and an LED module LM. As shown in FIG. 1A, the LED lighting apparatus 100 in this embodiment may include a plurality of LED lighting apparatuses or lamps for operation with the dimmer 80, such as the LED lighting apparatuses **100_1-100_*n***, wherein the symbol n is a positive integer larger than or equal to 2.

In the LED lighting system 10 of FIG. 1A, an input terminal or input terminals of the dimmer 80 are electrically connected to an external power grid or power supply EP, in order to receive input power Pin (which can also be referred to as an input power signal Pin) from the external power grid EP. Output terminals of the dimmer 80 are electrically connected to the LED lighting apparatus 100 through first and second connection terminals T1 and T2 of the LED lighting apparatus 100, in order to transmit/provide input power Pin_C resulting from a dimming process to the LED lighting apparatus 100. Accordingly, the external power grid EP is electrically connected to the LED lighting apparatus 100 through the dimmer 80, in order to provide power for the LED lighting apparatus 100 to use. The input power Pin or Pin_C may be AC power source or DC power source; may refer to at least one of input voltage, input current, or rate of inputting electrical energy; and may be referred to as input power signal Pin or Pin_C hereinafter. Also, in the LED lighting system 10 of FIG. 1A, a power loop formed between the external power grid EP and the LED lighting apparatus 100 may be regarded or defined as comprising the power line for the LED lighting system 10 or the LED lighting apparatus 100.

The LED lighting apparatus 100 is configured to receive the input power Pin_C through its first and second connection terminals T1 and T2, and the power supply module PM is configured to generate driving power Sdry (which can also be referred to as a driving power signal Sdrv), based on the received input power Pin_C, for the LED module LM, in order for the LED module LM to light up in response to the driving power Sdrv. In various embodiments, the LED lighting apparatus 100 may comprise or be any of various types of LED lamps, such as LED spotlight, LED downlight, LED bulb lamp/light, LED track light, LED panel light, LED ceiling light, LED tube lamp/light, or LED filament lamp/light, but the present invention is not limited to any of these types. In some embodiments, the LED lighting apparatus 100 comprises an LED tube lamp, which can be referred to a ballast-compatible type (i.e., Type-A) LED tube lamp, a ballast-bypass type (i.e., Type-B) LED tube lamp, or an external driving type (i.e., Type-C) LED tube lamp.

From the perspective of overall operation of the LED lighting system 10, the dimmer 80 is configured to perform a dimming process on the received input power Pin according to a signal DIM for dimming, hereinbelow a dimming signal DIM, and is configured to generate the input power Pin_C resulting from the dimming process (referred to herein for convenience as a dimmer-adjusted input power Pin_C). By a control interface 50 as in FIG. 1A a user can cause a suitable dimming signal DIM to be provided to the dimmer 80. The control interface 50 may comprise or be implemented by various structures such as a switch, a knob, or a wireless signal receiver, but the present invention is not limited to any of these structures. Also, according to the chosen way to perform dimming, the dimming process may be directed to changing or adjusting any signal feature of the input power Pin, such as its phase conduction angle, frequency, amplitude, phase, or any combination thereof. The dimmer 80 includes at least one controllable electronic element, such as a bidirectional triode thyristor (or TRIAC), a single-chip microcomputer, or a transistor, coupled or connected to the power line, generally referred to as a dimmer circuit. And the controllable electronic element may be configured to adjust a chosen signal feature of the input power Pin in response to the dimming signal DIM, in order to transform the received input power Pin into the input power Pin_C resulting from the adjusting. In some cases, such as where the dimmer 80 is set to NOT cause dimming of the light, the dimmer-adjusted input power Pin_C may be the same as the input power Pin.

When the LED lighting apparatus 100 receives the input power Pin_C, the power supply module PM then transforms the received input power Pin_C into a stable driving power Sdry for the LED module LM to use, wherein the power supply module PM may generate the signal of driving power Sdry in the form of voltage (referred to as driving voltage) and/or current (referred to as driving current) corresponding to or based on the signal feature of the received input power Pin_C. Upon the driving power Sdry being generated, the LED module LM is configured to light up or emit light in response to the driving power Sdrv. The luminance or brightness of the LED module LM is related to the magnitude of the driving voltage and/or driving current of the driving power Sdrv, which is/are adjusted based on the signal feature of the received input power Pin_C, and the signal feature of the received input power Pin_C is controlled by the dimming signal DIM. Therefore, the dimming signal DIM is directly related to the luminance or brightness of the LED module LM. The signal processing involved in the operation of the power supply module PM for converting the received input power Pin_C into the driving power Sdry includes, but is not limited to, electrical rectification, electrical filtering, and DC-to-DC conversion. Some description is presented below of some embodiments of performing these steps for generating the driving power Sdrv.

Figure 1B:
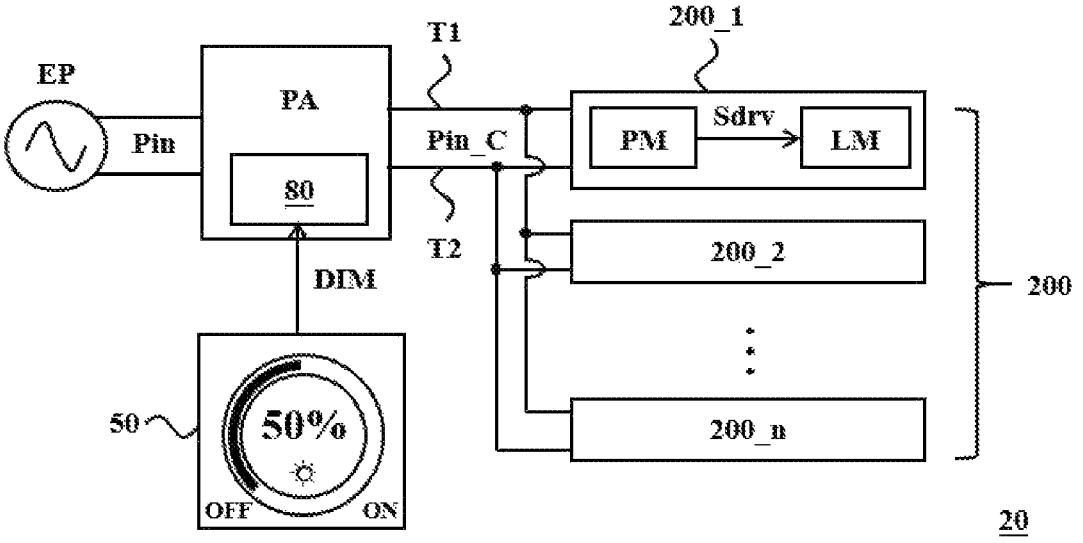
FIG. 1B is a block diagram of an LED lighting system according to another embodiment of the disclosure.

FIG. 1B is a block diagram of an LED lighting system 20 according to another embodiment of the disclosure, including an LED lighting apparatus 200, which may include a plurality of LED lighting apparatuses or lamps for operation with a dimmer 80. Referring to FIG. 1B, the LED lighting system 20 includes a dimmer 80 and a plurality of LED lighting apparatuses **200_1-200_*n*, wherein the symbol n is a positive integer larger than or equal to 2. In the LED lighting system 20, configuration(s) and function(s) of the dimmer 80 and each of the plurality of LED lighting apparatuses 200_1_200_*n* can be, and are assumed to be, the same as those of the dimmer 80 and the LED lighting apparatus 100 in the embodiment of FIG. 1A, wherein in both the embodiments of FIG. 1A and FIG. 1B the plurality of LED lighting apparatuses (100_1-100_*n* or 200_1-200_*n*) are arranged or connected in parallel with each other, i.e., first connection terminals T1 respectively of the LED lighting apparatuses (100_1-100_*n* or 200_1-200_*n*) are electrically connected together, and second connection terminals T2 respectively of the LED lighting apparatuses (100_1-100_*n* or 200_1-200_*n*) are electrically connected together. A difference between the two embodiments of FIGS. 1A and 1B is that a power adaptor PA includes a dimmer 80 disposed therein for the embodiment of FIG. 1B and is adopted in place of the mere dimmer 80 of the embodiment of FIG. 1**A.

Under the configurations of the embodiment of FIG. 1B, the input power Pin_C in FIG. 1B may be concurrently provided to every one of the LED lighting apparatuses **200_1-200_*n*, which are then concurrently caused to light up. So, in some embodiments, when a dimming signal DIM in FIG. 1B is applied or adjusted, the luminance respectively of the LED lighting apparatuses 200_1-200_*n* are then concurrently caused to change. Since the dimming control of the LED lighting system 20 of FIG. 1B can be implemented by adjusting or modulating a signal feature of the input power Pin, a separate signal line connected to each of the LED lighting apparatuses 200_1-200_*n* and for receiving a dimming signal is not needed, thus greatly simplifying the layout of electrical wiring(s) between included elements and reducing complexity of installations thereof for control of a plurality of LED lighting apparatuses in the application environment of the LED lighting system 20**.

Figure 2:
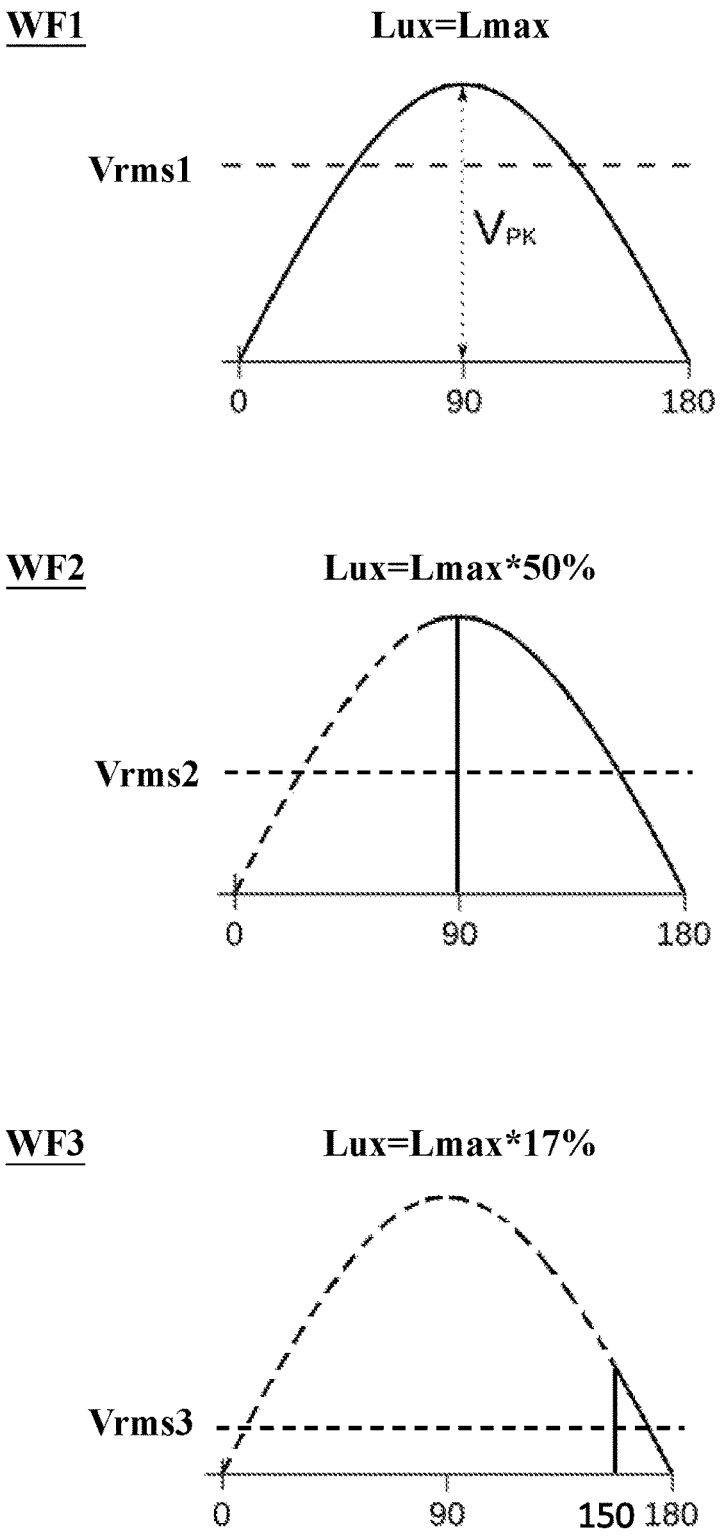
FIG. 2 is a signal waveform diagram of signal waveforms illustrating dimming or adjusting of brightness/luminance in a lighting system of an LED lighting apparatus.

Specifically, there are various applicable ways to implement dimming control by adjusting a signal feature of the input power Pin. A common way is to vary or adjust the effective or RMS (root-mean-square) value of the input power signal Pin by adjusting the phase conduction angle of the input power signal Pin, in order to adjust the magnitude of the driving power Sdrv. A description follows of a method of dimming control and corresponding circuit operations in such a common way with reference to FIGS. 1A and 2, wherein FIG. 2 is a signal waveform diagram of signal waveforms illustrating dimming or adjusting of brightness/luminance in a lighting system of an LED lighting apparatus. Referring to FIGS. 1A and 2, in the description of the present embodiment, the external power grid EP is assumed to provide AC power as the input power Pin for example, and the signal waveforms of FIG. 2 illustrate voltage waveforms for a (positive) half cycle of the input power Pin having an amplitude VPK for example. In FIG. 2, the signal waveforms from top to bottom are respectively voltage waveforms WF1, WF2, and WF3 corresponding to three different dimming control states or situations of the luminance Lux (of the LED lighting apparatus 100 of FIG. 1A) being at its maximum Lmax, being at 50% of its maximum Lmax, and being at 17% of its maximum Lmax, respectively. In these embodiments of FIG. 2, the dimmer 80 of FIG. 1A may be configured to adjust the phase-cut angle (or phase conduction angle) of the input power Pin by controlling the current conduction or cutoff state of the controllable electronic element electrically connected on the power line in series. For example, in order to modulate the input power Pin to have a phase-cut angle of 90 degrees, the dimmer of FIG. 1A may be configured to cut off the controllable electronic element at or within ¼ cycle of the input power signal Pin and then maintain or keep the controllable electronic element at the current conduction state for the rest of the half cycle of the input power signal Pin. In this way, for the half cycle of the input power signal Pin, the resulting voltage waveform has a value of zero for the phase angle of 0-90 degrees of the input power signal Pin and then has part of a sinusoidal waveform following that for the phase angle of 90-180 degrees of the input power signal Pin, but the invention is not limited to the forward phase-cut (i.e., the leading-edge dimming control). Accordingly, the input power signal Pin undergoes the cutting off of phase angle performed by the dimmer 80 to produce or result in the input power signal Pin_C with a phase conduction angle of 90 degrees. There are other embodiments of modulating the input power signal Pin to have a phase-cut angle that have principles similar to the described principle of this example.

Regarding the voltage waveform WF1 of FIG. 2 first, when the dimmer 80 in response to the dimming signal DIM modulates the input power Pin to have a phase-cut angle of 0 degree, meaning the input power Pin has a phase conduction angle of 180 degrees, the dimmer 80 directly provides or reproduces the input power signal Pin to the LED lighting apparatus 100 of FIG. 1A, so the input power signal Pin_C is the same as or corresponds to the input power signal Pin. In this case, assuming the effective value of the input power signal Pin_C to be Vrms1, the power supply module PM of FIG. 1A then generates a corresponding driving power Sdrv, based on the input power signal Pin_C of the effective value Vrms1, in order to drive the LED module LM of FIG. 1A so that the luminance Lux of the LED module LM is at its maximum level Lmax.

Regarding the voltage waveform WF2 of FIG. 2, when the dimmer 80 in response to the dimming signal DIM modulates the input power Pin to have a phase-cut angle of 90 degrees, meaning the input power Pin has a phase conduction angle of 90 degrees, the dimmer 80 cuts off the power line for the phase angle of 0-90 degrees of the input power signal Pin and then causes current conduction through the power line for the phase angle of 90-180 degrees of the input power signal Pin. In this case, the effective value of the input power signal Pin_C is smaller than the effective value Vrms1 and assumed to be Vrms2, and the input power signal Pin_C of the effective value Vrms2 causes the luminance Lux of the LED module LM to be at 50% of its maximum level Lmax.

Next regarding the voltage waveform WF3 of FIG. 2, when the dimmer 80 in response to the dimming signal DIM modulates the input power Pin to have a phase-cut angle of 150 degrees, meaning the input power Pin has a phase conduction angle of 30 degrees, the dimmer 80 cuts off the power line for the phase angle of 0-150 degrees of the input power signal Pin and then causes current conduction through the power line for the phase angle of 150-180 degrees of the input power signal Pin. In this case, the effective value of the input power signal Pin_C is smaller than the effective value Vrms2 and assumed to be Vrms3, and the input power signal Pin_C of the effective value Vrms3 causes the luminance Lux of the LED module LM to be at 17% of its maximum level Lmax.

According to the dimming method described above with reference to FIGS. 1A and 2, by modulating the input power signal Pin to have a phase-cut angle or a phase conduction angle the dimmer 80 of FIG. 1A can cause corresponding variation in the effective value of the input power signal Pin_C, which may be varied to be, e.g., Vrms1, Vrms2, or Vrms3. In practice, the caused variation in the effective value of the input power signal Pin_C is typically in positive correlation with the variation in its phase conduction angle, that is, the larger the phase conduction angle of the input power signal Pin_C the larger its effective value. Accordingly, the caused variation in the effective value of the input power signal Pin_C is typically in negative correlation with the variation in its phase-cut angle. Thus, the described common way of dimming control realizes the function of dimming control by adjusting the effective value of the input power signal Pin. An advantage of this common way is that because the generated driving power Sdry varies directly corresponding to the variation in the effective value of the input power signal Pin_C, original hardware structures or parts of a regular LED lighting apparatus 100 need not be retrofitted or adapted for realizing dimming control, for which purpose mainly adding a dimmer 80 is needed in an LED lighting system.

More specifically, in the common way of implementing dimming control, in order to cause a sufficient variation in the effective value of the input power signal Pin_C for tuning the luminance/brightness of the LED module, the dimmer 80 must adjust or modulate the phase-cut angle (or the phase conduction angle) in a relative wide range to adjust the effective value of the input power signal Pin_C. The relative wide range of the phase-cut angle can refer to, for example, from 0 degree to 180 degrees as illustrated in FIG. 2. However, when the phase conduction angle of the input power signal Pin_C is small to a degree, the operating power supply module PM might be negatively impacted by significant effects of characteristics such as total harmonic distortion (THD) and power factor (PF) such that the power conversion efficiency of the power supply module PM is significantly small or reduced, which may even cause the problem of light-flickering of the LED module LM. So, under this common way of the dimming control, it's hard to improve the power conversion efficiency of the power supply module PM, due to such limitations of the dimmer 80.

In another aspect, since the effective value of the modulating input power signal Pin_C is directly affected by the magnitude of the amplitude VPK, a dimmer 80 using the described common way of realizing dimming control may not be compatible with various voltage specifications of standard power grids, such as AC voltage specifications of 120V, 230V, and 277V. Therefore a designer likely needs to adjust parameters or hardware designs according to the application environment of an LED lighting system 10, which will increase the overall production cost of products of the LED lighting system 10.

In response to the above problems, the present disclosure presents a new dimming control method, and an LED lighting system and an LED lighting apparatus using the same. Each of the LED lighting system and LED lighting apparatus is configured to receive a dimmer-adjusted signal (which can also be referred to as a modulated signal) produced by varying the phase-cut angle or phase conduction angle of the input power Pin, then to obtain an actual dimming message by demodulating the dimmer-adjusted signal, and then according to the obtained dimming message, to control circuit operation(s) of the power supply module PM to generate the driving power Sdrv. Since variation of the phase-cut angle or phase conduction angle is intended for merely carrying the dimming message corresponding to a dimming signal DIM, but not for directly adjusting the effective value of the input power Pin_C, the dimmer 80 may vary the phase-cut angle or phase conduction angle of the input power Pin within a relatively small phase angle/range so as to cause a relatively small difference between effective values respectively of the dimmer-adjusted input power Pin_C and the input power Pin provided by the external power grid EP. By this way of dimming control, no matter under what luminance state, the phase conduction angle of the input power Pin will be similar to that of the modulating input power Pin_C, and therefore the characteristics of total harmonic distortion (THD) and power factor (PF) can be maintained/controlled, meaning the power conversion efficiency of the power supply module PM may not be inhibited or hindered by the dimmer 80. Further explanations of relevant structures and operations of the dimming control method and corresponding LED lighting apparatus/system taught by the disclosure are presented below.

Figure 3:
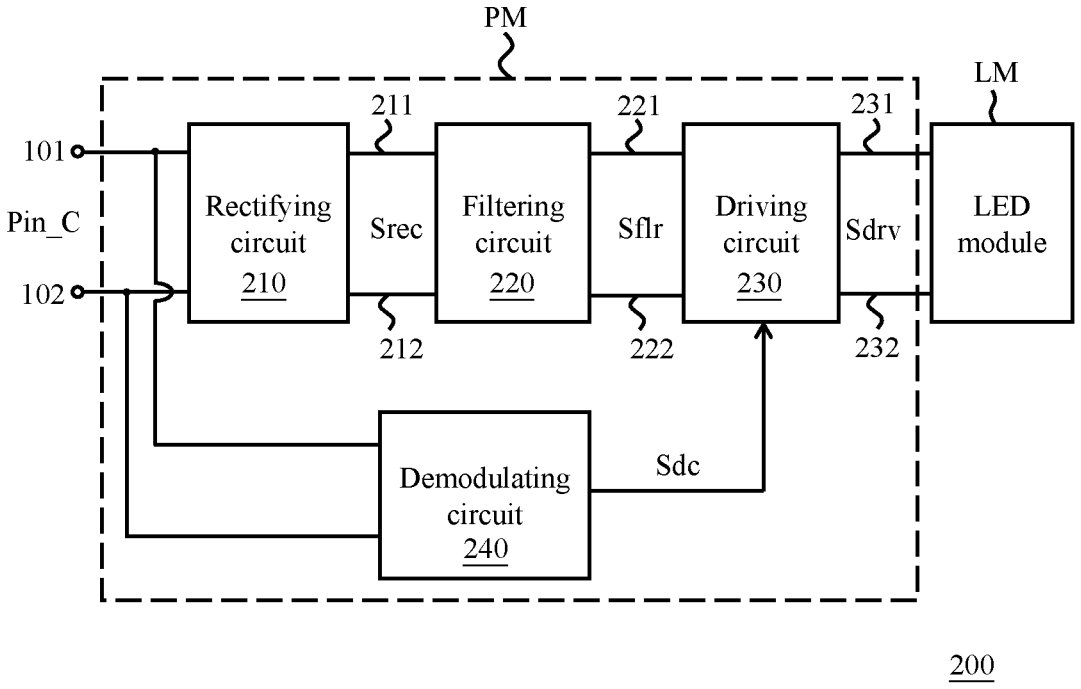
FIG. 3 is a circuit block diagram of an LED lighting apparatus according to an embodiment of the disclosure.

FIG. 3 is a circuit block diagram of an LED lighting apparatus according to an embodiment of the disclosure. Referring to FIG. 3, the LED lighting apparatus 200 may be applied in the LED lighting system 10 or 20 of FIGS. 1A and 1B. The LED lighting apparatus 200 includes a power supply module PM and an LED module LM, wherein the power supply module PM includes a rectifying circuit 210, a filtering circuit 220, a driving circuit 230, and a demodulating circuit 240. The LED lighting apparatus may be an LED lamp, or LED light bulb, for example.

The rectifying circuit 210 is configured to receive an input power Pin_C through first and second connection terminals 101 and 102, in order to rectify the input power Pin_C and then output a rectified signal Srec through first and second rectifying output terminals 211 and 212. The input power Pin_C may be or comprise an AC signal or DC signal, either type of signal can be compatible with designed operations of the LED lighting apparatus 200. The input power Pin_C may be, for example, the signal output from a dimmer circuit (e.g., a dimmer-adjusted input power signal). When the LED lighting apparatus 200 is designed to light based on an input DC signal, the rectifying circuit 210 in the power supply module PM may be omitted. When the rectifying circuit 210 is omitted, the first and second connection terminals 101 and 102 would be coupled directly to input terminal(s) of the filtering circuit 220, which would be the first and second rectifying output terminals 211 and 212 if the rectifying circuit 210 were present. In various embodiments, the rectifying circuit 210 may comprise a full-wave rectifying circuit, a half-wave rectifying circuit, a bridge-type rectifying circuit, or other type of rectifying circuit, and the disclosed invention is not limited to any of these types.

The filtering circuit 220 is electrically connected to the rectifying circuit 210, in order to electrically filter the rectified signal Srec, wherein input terminals of the filtering circuit 220 are coupled to the first and second rectifying output terminals 211 and 212 in order to receive and then electrically filter the rectified signal Srec. A resulting filtered signal Sflr is output at first and second filtering output terminals 221 and 222. It's noted that the first rectifying output terminal 211 may be regarded as the first filtering output terminal 221 and the second rectifying output terminal 212 may be regarded as the second filtering output terminal 222. In certain embodiments, the filtering circuit 220 can filter out ripples of the rectified signal Srec, causing the waveform of the filtered signal Sflr to be smoother than that of the rectified signal Srec. In addition, circuit configurations of the filtering circuit 220 may be designed so as to filter as to a specific frequency, for example, to filter out circuit response to a specific frequency of an input external driving signal. In some embodiments, the filtering circuit 220 is a circuit comprising at least one of a resistor, a capacitor, or an inductor, such as a parallel-connected capacitor filter or a pi-shape filter, but the invention is not limited to any of these types of filtering circuit. As is well known, a pi-shape filter looks like the symbol $\pi$ in its shape of circuit schematic.

The driving circuit 230 is electrically connected to the filtering circuit 220, in order to receive, and then perform power conversion on, the filtered signal Sflr, to produce a driving power signal Sdrv, wherein input terminals of the driving circuit 230 are coupled to the first and second filtering output terminals 221 and 222 in order to receive the filtered signal Sflr and then produce the driving power signal Sdry for driving the LED module LM to emit light. It's noted that the first filtering output terminal 221 may be regarded as a first driving output terminal 231 of the driving circuit 230 and/or the second filtering output terminal 222 may be regarded as a second driving output terminal 232 of the driving circuit 230. The driving power signal Sdry produced by the driving circuit 230 is then provided to the LED module LM through the first driving output terminal 231 and second driving output terminal 232, to cause the LED module LM to light up in response to the received driving power signal Sdrv. Further explanation of an embodiment of the driving circuit 230 is as follows with reference to FIG. 4.

Figure 4:
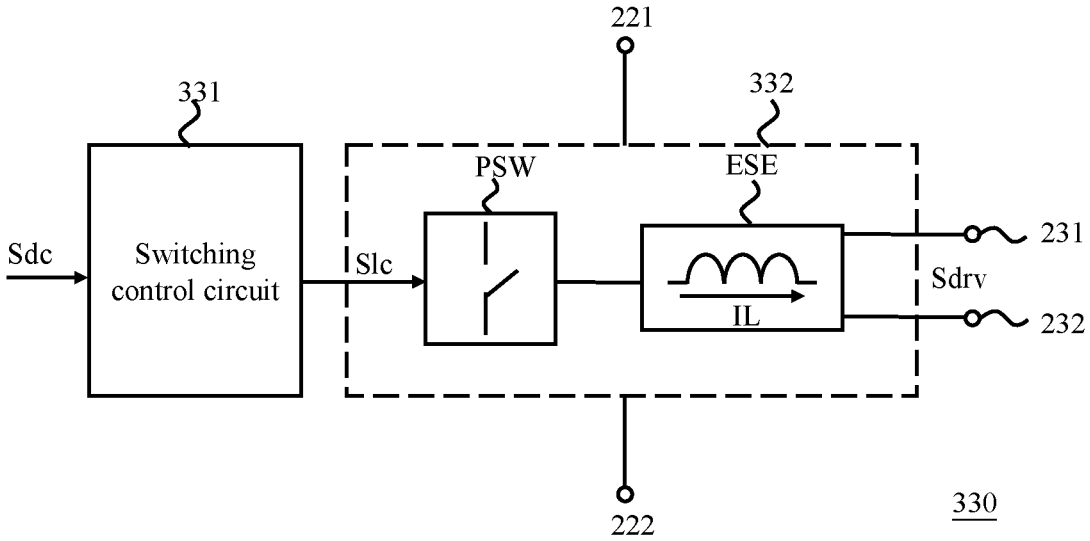
FIG. 4 is a circuit block diagram of a driving circuit according to an embodiment of the disclosure.

FIG. 4 is a circuit block diagram of a driving circuit according to an embodiment of the disclosure. With reference to both FIGS. 3 and 4, a driving circuit 330 of FIG. 4 is an embodiment of the driving circuit 230 of FIG. 3, and includes a switching control circuit 331 and a conversion circuit 332 for power conversion based on a current source, for driving the LED module LM to emit light. The conversion circuit 332 includes a switching circuit PSW (also known as a power switch) and an energy storage circuit ESE. The conversion circuit 332 is coupled to the first and second filtering output terminals 221 and 222 in order to receive and then convert the filtered signal Sflr, under the control by the switching control circuit 331, into a driving power signal Sdry output at the first and second driving output terminals 231 and 232 for driving the LED module LM. The conversion circuit may additionally include a diode (not shown). For example, a diode and switching circuit PSW may be connected in series between first and second filtering output terminals 221 and 222, with the energy storage circuit ESE connected at one end to a node between the diode and the switching circuit PSW and connected at an opposite end to one of the first or second driving output terminals 231 or 232. An end of one of the diode or the switching circuit PSW opposite the node may connect directly to one of the first or second filtering output terminals 221 or 222, while the other of the first or second driving output terminals 231 or 232 may be directly connected to the other of the first or second filtering output terminals 221 or 222. Under the control by the switching control circuit 331, the driving power output by the conversion circuit 332 comprises a steady current, making the LED module LM emit steady light. Further, the driving circuit 330 may include a bias circuit (not shown in FIG. 4), which may be configured to generate a working voltage Vcc based on a power line voltage of the power supply module PM and to be used by the switching control circuit 331, for the switching control circuit 331 to be activated and operate in response to the working voltage Vcc.

The switching control circuit 331 in this embodiment of FIG. 4 is configured to perform real-time regulation or adjusting of the duty cycle of a lighting control signal Slc according to current operational states of the LED module LM, in order to conduct or cut off the switching circuit PSW according to or in response to the lighting control signal Slc. The switching control circuit 331 can determine or judge a current operational state of the LED module LM by detecting one or more of an input voltage (such as a voltage level on the first connection terminal 101 or the second connection terminal 102, on the first rectifying output terminal 211, or on the first filtering output terminal 221), an output voltage (such as a voltage level on the first driving output terminal 231), an input current (such as a current on the input power line or flowing through the rectifying output terminal 211/212 and the filtering output terminal 221/222), and an output current (such as a current flowing through the driving output terminal 231/232 or energy storage circuit ESE or the switching circuit PSW). The energy storage circuit ESE is configured to alternate or switch its operation between being charged with energy and discharging energy, according to the state of the switching circuit PSW either conducting or being cut off, in order to maintain or make the driving power signal Sdry received by the LED module LM be stably above a predefined current value Ipred.

The demodulating circuit 240 of FIG. 3 has input terminals electrically connected to the first and second connection terminals 101 and 102 in order to receive an input power Pin_C, and has an output terminal electrically connected to the driving circuit 230 in order to provide a dimming control signal Sdc to the driving circuit 230. The demodulating circuit 240 is configured to generate the dimming control signal Sdc according to the magnitude of the phase-cut angle or conduction phase angle applied for each cycle or half-cycle of the input power signal Pin_C, wherein the switching control circuit 331 is configured to adjust its output of the lighting control signal Slc according to the dimming control signal Sdc so as to cause the driving power signal Sdry to vary in response to variation of the lighting control signal Slc. For example, the switching control circuit 331 is configured to adjust the duty cycle of the lighting control signal Slc according to the dimming control signal Sdc, so as to cause the driving power signal Sdry to increase or decrease in response to a luminance message indicated by the dimming control signal Sdc. When the dimming control signal Sdc indicates a higher luminance or color temperature, the switching control circuit 331 may increase the duty cycle of the lighting control signal Slc according to the dimming control signal Sdc, so as to cause the energy storage circuit ESE to output a higher driving power signal Sdry for the LED module LM. On the contrary, when the dimming control signal Sdc indicates a lower luminance or color temperature, the switching control circuit 331 may decrease the duty cycle of the lighting control signal Slc according to the dimming control signal Sdc, so as to cause the energy storage circuit ESE to output a lower driving power signal Sdry for the LED module LM. The duty cycle may refer, for example, to a percentage of time during a cycle (or half-cycle) for which the lighting control signal Slc has sufficient voltage to turn on switching circuit PSW. By these ways of adjusting, effects of dimming control can be achieved.

More specifically, the demodulation process performed by the demodulating circuit 240 may comprise a signal conversion method such as sampling, time counting, or mapping or functioning between signals. For example, for each cycle or half cycle of the input power signal Pin_C, the demodulating circuit 240 may count for a period of time, and sample the input power signal Pin_C within the period of time to obtain the time length for which the input power signal Pin_C remains at a zero voltage level. For example, the input power signal Pin_C may be output from a dimmer circuit that sets the input power signal Pin_C to zero volts for a particular portion of the input power signal cycle. Since the cycle of the input power signal Pin_C is fixed, the phase-cut angle can be obtained by calculating the ratio of the time length that the input power signal Pin_C remains at the zero voltage level to the time length of the cycle of the input power signal Pin_C. The time length that the input power signal Pin_C remains at the zero voltage level corresponds to the phase-cut angle directly. Therefore, the demodulating circuit 240 can convert the phase-cut angle into a dimming control signal Sdc capable of controlling the switching control circuit 331 by mapping the time length that the input power signal Pin_C remains at the zero voltage level, for example linearly or nonlinearly, into a voltage level. This dimming control signal Sdc may correspond to dimming signal DIM, which serves as a dimming message to control the amount of dimming. The range of the voltage level after mapping may be selected according to the voltage rating of the switching control circuit 331, and is for example between 0V and 5V. Further description of signal waveforms and circuit operations in an LED lighting system including the LED lighting apparatus 200 under different dimming control states or situations is as follows with reference to FIGS. 5A and 5B, which is a signal waveform diagram of signal waveforms illustrating dimming or adjusting of luminance according to an embodiment of the disclosure.

Figure 5A:
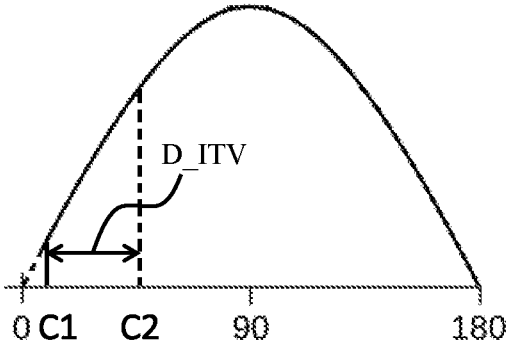
FIGS. 5A and 5B are signal waveform diagrams of signal waveforms illustrating dimming or adjusting of luminance according to certain embodiments of the disclosure.
Figure 5A:
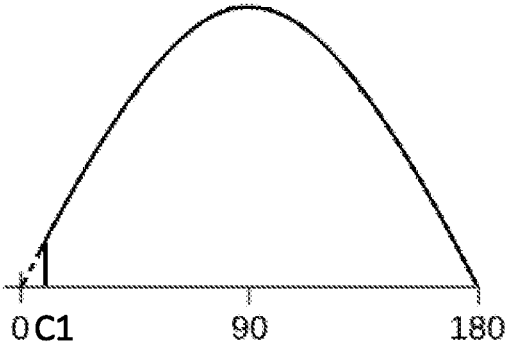
Figure 5A:
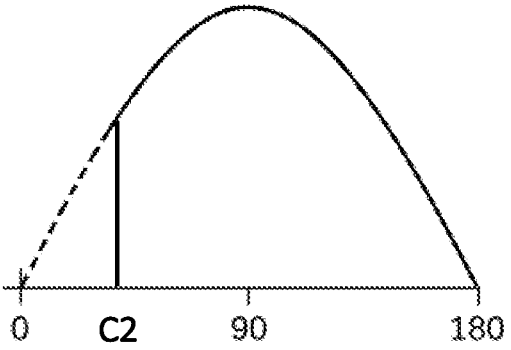

Referring to FIGS. 3 to 5A, in this embodiment, the dimmer 80 in either FIG. 1A or 1B may for example vary the phase-cut angle of the input power signal Pin within a dimming phase range D_ITV. In FIG. 5A, the signal waveforms from top to bottom are respectively a voltage waveform WF4 showing the dimming phase range D_ITV, a voltage waveform WF5 corresponding to the dimming control state of the luminance Lux (of the LED lighting apparatus 200 of FIG. 3) being at its maximum Lmax, and a voltage waveform WF6 corresponding to the dimming control state of the luminance Lux being at its minimum Lmin.

With regard to the voltage waveform WF4 in the embodiment of FIG. 5A first, the dimming phase range D_ITV is the difference between a maximum phase-cut angle C2 and a minimum phase-cut angle C1, which minimum phase-cut angle C1 may be any number (such as 1, 2, or 3) of degrees in the range of between 0 and 15 degrees and which maximum phase-cut angle C2 may be any number (such as 21, 22, or 23) of degrees in the range of between 20 and 45 degrees, but the present invention is not limited to any of these ranges. So the dimming phase range D_ITV may be for example a phase difference between 0 and 45 degrees, between 5 and 45 degrees, between 5 and 20 degrees, between 15 and 20 degrees, or between 15 and 45 degrees, depending on the design needs. Note that these examples are for an amount of phase-cut angle within a half-cycle (i.e., 180 degrees), and may be described as a certain phase-cut ratio or percentage (e.g., where 45 degrees corresponds to a 25% phase cut of a cycle or half-cycle, etc.). Preferably the choice of the maximum phase-cut angle C2 is based on two factors or principles. The first factor is that the size of the dimming phase range D_ITV should afford distinguishable states of luminance after mapping performed by the demodulating circuit 240. And the second factor is that when the dimmer 80 produces the input power signal Pin_C having the maximum phase-cut angle C2, the characteristics of total harmonic distortion (THD) and power factor (PF) of the power supply module PM of FIG. 3 can still be maintained/controlled, for example having values of the THD and PF no smaller than 80% of values of the THD and PF when the dimmer 80 produces the input power signal Pin_C having the minimum phase-cut angle C1, or preferably the value of the THD is larger than 25 and the value of the PF is larger than 0.9.

With regard to the voltage waveform WF5 of FIG. 5A, when the dimmer 80 in response to the dimming signal DIM modulates the input power Pin to result in the minimum phase-cut angle C1, meaning the input power signal Pin_C has a conduction phase angle of (180-C1) degrees, the dimmer 80 cuts off the power line for the phase angle of 0-C1 degrees of the input power signal Pin and then causes current conduction through the power line for the phase angle of C1-180 degrees of the input power signal Pin. In this case, the demodulating circuit 240 generates a dimming control signal Sdc indicative of adjusting the luminance Lux to its maximum Lmax, according to the input power signal Pin_C having the minimum phase-cut angle C1. Then upon receiving the generated dimming control signal Sdc the switching control circuit 331 controls switching of the switching circuit PSW according to the dimming control signal Sdc as a reference, in order for the conversion circuit 332 to generate a corresponding driving power signal Sdry for driving the LED module LM and causing its luminance Lux to reach or stay at the maximum Lmax.

Next, with regard to the voltage waveform WF6 of FIG. 5A, when the dimmer 80 in response to the dimming signal DIM modulates the input power Pin to result in the maximum phase-cut angle C2, meaning the input power Pin_C2 has a conduction phase angle of (180-C2) degrees, the dimmer 80 cuts off the power line for the phase angle of 0-C2 degrees of the input power signal Pin and then causes current conduction through the power line for the phase angle of C2-180 degrees of the input power signal Pin. In this case, the demodulating circuit 240 generates a dimming control signal Sdc indicative of adjusting the luminance Lux into its minimum Lmin, according to the input power signal Pin_C having the maximum phase-cut angle C2. Then upon receiving the generated dimming control signal Sdc the switching control circuit 331 controls switching of the switching circuit PSW according to the dimming control signal Sdc as a reference, in order for the conversion circuit 332 to generate a corresponding driving power signal Sdry for driving the LED module LM and causing its luminance Lux to reach or stay at the minimum Lmin. In this embodiment, the minimum luminance Lmin is for example about 10% of the maximum luminance Lmax.

In comparison to the described dimming control method illustrated by FIG. 2, although the phase-cut angle or phase conduction angle is applied for dimming control, variation of the phase-cut angle or conduction phase angle of the resulting input power signal Pin_C in this embodiment of FIG. 5A is merely used as a reference signal indicative of a dimming message, rather than reflecting the effective value of the input power signal Pin_C in the luminance of the lighting LED module LM. So under the dimming control method of this embodiment of FIG. 5A the chosen dimming phase range D_ITV would be apparently smaller than that under the dimming control method of the embodiment of FIG. 2. From another perspective, under the dimming control method of this embodiment of FIG. 5A, no matter whether the dimmer 80 modulates the input power signal Pin by any particular phase-cut angle within the dimming phase range D_ITV, the effective value of the resulting input power signal Pin_C will not be much different. For example, in some embodiments, the effective value of the resulting input power signal Pin_C having the maximum phase-cut angle C2, such as the effective value of the voltage waveform WF6 of FIG. 5A, is not lower than 50% of the effective value of the resulting input power signal Pin_C having the minimum phase-cut angle C1, such as the effective value of the voltage waveform WF5 of FIG. 5.

From another perspective, in the ordinary dimming control method described in FIG. 2, since the luminance of the LED module lighting based on the received modulated input power signal Pin_C is directly correlated with the effective value of the modulated input power signal Pin_C, the scope ratio of the effective value of the modulated input power signal Pin_C is substantially or roughly the same as the scope ratio of the luminance of the lighting LED module, wherein the scope ratio of the effective value of the modulated input power signal Pin_C refers to the ratio of the maximum value to the minimum value of the effective value (e.g., RMS value) of the modulated input power signal Pin_C, and the scope ratio of the luminance of the lighting LED module refers to the ratio of the maximum value to the minimum value of the luminance. On the contrary, according to the embodiments described of FIG. 5A, the scope ratio of the effective value of the modulated input power signal Pin_C is not correlated with the scope ratio of the luminance of the lighting LED module. In some preferable embodiments, the scope ratio of the effective value of the modulated input power signal Pin_C is smaller than the scope ratio of the luminance of the lighting LED module. And in some preferable embodiments, the scope ratio of the effective value of the modulated input power signal Pin_C is smaller than or equal to 2 (e.g., ratio of RMS value at the maximum modulated input power to RMS value at the minimum modulated input power), and the scope ratio of the luminance of the lighting LED module is larger than or equal to 10 (e.g., ratio of luminance when the maximum modulated input power is supplied to the luminance when the minimum modulated input power is supplied). The scope ratio of the luminance of the lighting LED module may therefore be more than twice the scope ratio of the effective value of the modulated input power signal Pin_C, and in some cases more than 5 times the scope ratio of the effective value of the modulated input power signal Pin_C.

It should be noted that the described positive correlation of the luminance Lux of the LED module LM with respect to the variation of the phase-cut angle is only exemplary but is not limiting, and in other embodiments the luminance Lux of the LED module LM may be in negative correlation with the cut-off phase angle of the modulated input power signal Pin_C.

Figure 5B:
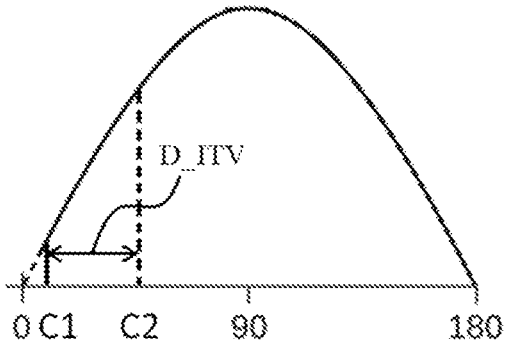
Figure 5B:
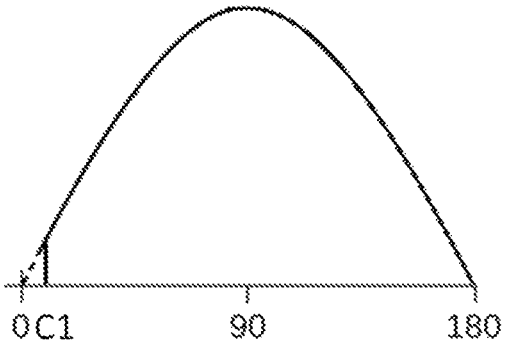
Figure 5B:
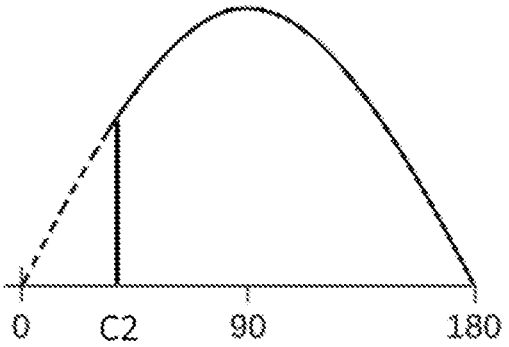

Referring to FIG. 5B, for example, with respect to the voltage waveform WF7 in this embodiment, when the dimmer 80 in response to a dimming signal DIM modulates the input power Pin to result in the minimum cut-off phase angle C1, meaning the input power Pin has a conduction phase angle of (180-C1) degrees, the dimmer 80 cuts off the power line for the phase angle of 0~C1 degrees of the input power signal Pin and then causes current conduction through the power line for the phase angle of C1~180 degrees of the input power signal Pin. In this case, the demodulating circuit 240 generates a dimming control signal Sdc indicative of adjusting the luminance Lux into its minimum Lmin, according to the modulated input power signal Pin_C having the cut-off phase angle C1. Then upon receiving the generated dimming control signal Sdc the switching control circuit 331 controls switching of the switching circuit PSW according to the dimming control signal Sdc as a reference, in order for the conversion circuit 332 to generate a corresponding driving power signal Sdry for driving the LED module LM and causing its luminance Lux to reach or stay at the minimum luminance Lmin.

Next referring the voltage waveform WF8 of FIG. 5B, when the dimmer 80 in response to a dimming signal DIM modulates the input power Pin to result in the cut-off phase angle C2, meaning the input power Pin has a conduction phase angle of (180-C2) degrees, the dimmer 80 cuts off the power line for the phase angle of 0 to C2 degrees of the input power signal Pin and then causes current conduction through the power line for the phase angle of C2 degrees to 180 degrees of the input power signal Pin. In this case, the demodulating circuit 240 generates a dimming control signal Sdc indicative of adjusting the luminance Lux into its maximum Lmax, according to the modulated input power signal Pin_C having the cut-off phase angle C2. Then upon receiving the generated dimming control signal Sdc the switching control circuit 331 controls switching of the switching circuit PSW according to the dimming control signal Sdc as a reference, in order for the conversion circuit 332 to generate a corresponding driving power signal Sdry for driving the LED module LM and causing its luminance Lux to reach or stay at the maximum Lmax. It is noted that in the embodiments of both FIGS. 5A and 5B, the cut-off phase angle C2 is larger than the cut-off phase angle C1.

From one perspective, in the embodiment of FIG. 5A, the luminance Lux of the LED module LM is in negative correlation with the cut-off phase angle of the modulated input power Pin_C, and in the embodiment of FIG. 5B the luminance Lux of the LED module LM is in positive correlation with the cut-off phase angle of the modulated input power Pin_C. From another perspective, in the embodiment of FIG. 5A the luminance Lux of the LED module LM is in positive correlation with the effective value of the modulated input power Pin_C, and in the embodiment of FIG. 5B the luminance Lux of the LED module LM is in negative correlation with the effective value of the modulated input power Pin_C. In contrast, in the above described common way of varying or adjusting the effective value of the input power signal Pin the luminance Lux of the LED module LM can only be in positive correlation with the effective value of the modulated input power Pin_C. But with the present invention of this disclosure, the type of correlation between the luminance Lux of the LED module LM and the effective value or the phase-cut angle of the modulated input power Pin_C may be selected preferably according to actual or practical needs. Therefore, according to this disclosure, for example, it may be that the luminance Lux of the LED module LM is not directly proportional to the effective value of the modulated input power Pin_C.

Figure 6:
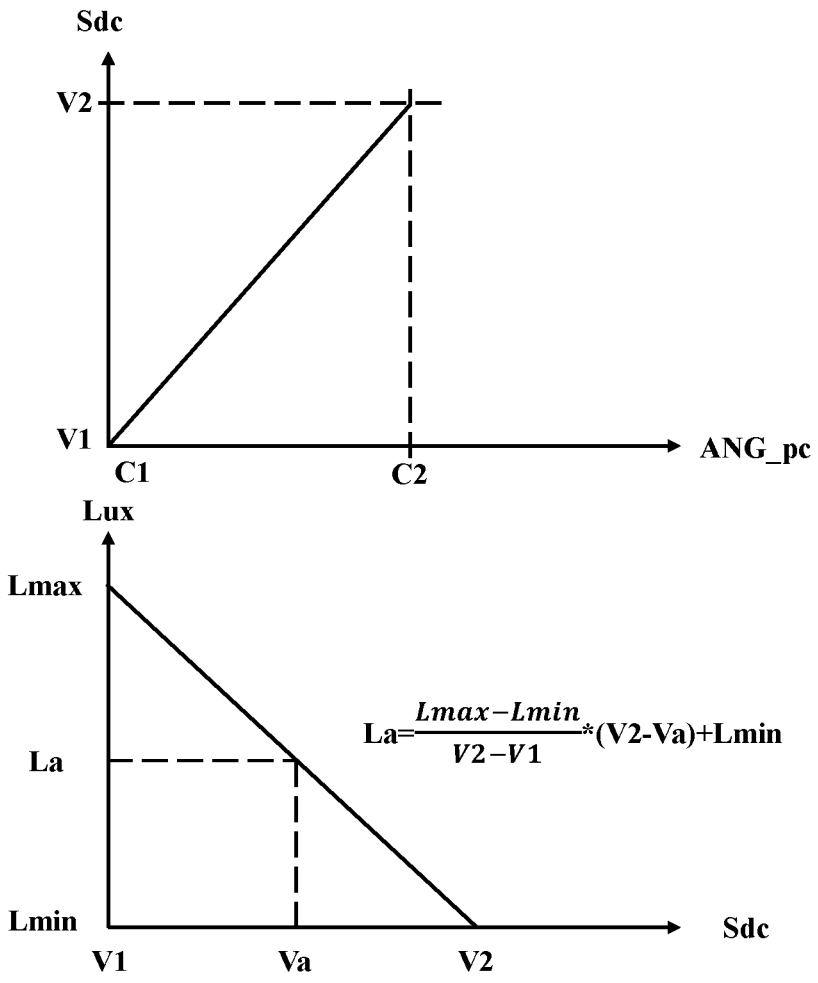
FIG. 6 illustrates a corresponding relationship between the three variables of a phase-cut angle for dimming, a demodulating signal, and the luminance of an LED module, according to an embodiment of the disclosure.
Figure 7:
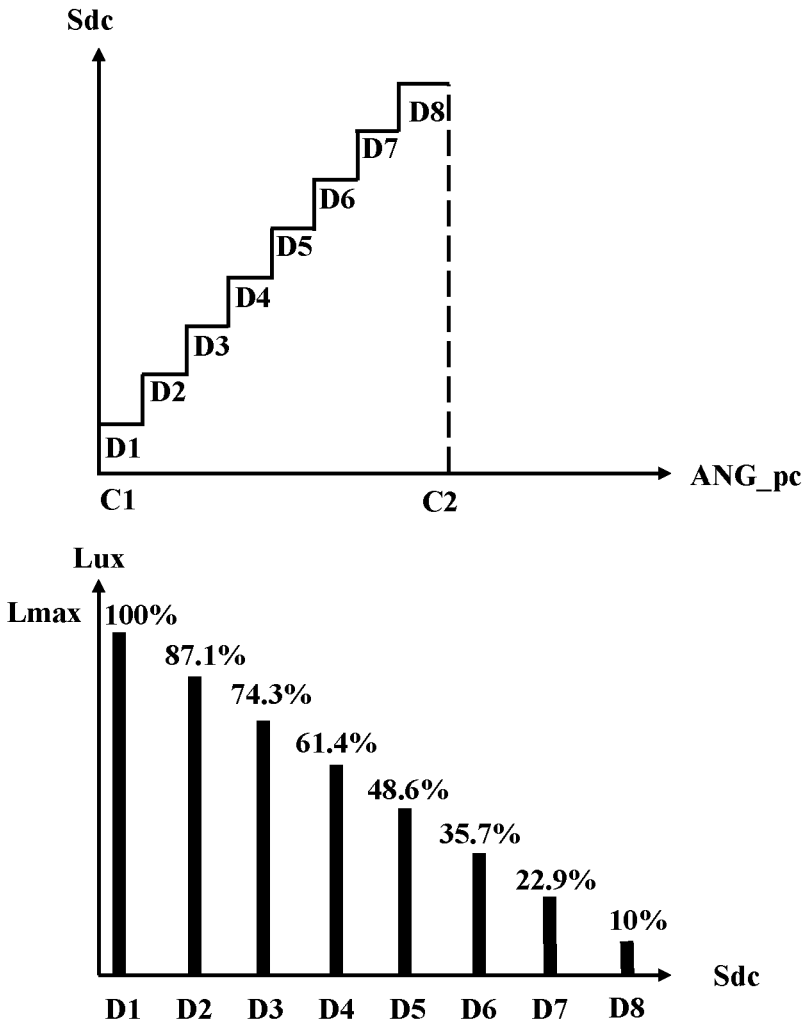
FIG. 7 illustrates a corresponding relationship between the three variables of a phase-cut angle for dimming, a demodulating signal, and the luminance of an LED module, according to another embodiment of the disclosure.

Next is a further description of circuit operations and mechanisms of signal generation in different embodiments of the demodulating circuit 240 illustrated by FIGS. 6 and 7. FIG. 6 illustrates a corresponding relationship between the three variables of a phase-cut angle for dimming, a demodulating signal, and the luminance of an LED module, according to an embodiment of the disclosure, and FIG. 7 illustrates a corresponding relationship between the three variables of a phase-cut angle for dimming, a demodulating signal, and the luminance of an LED module, according to another embodiment of the disclosure.

Referring to FIGS. 3, 4, and 6, the demodulating circuit 240 of this embodiment of FIG. 6 is configured to obtain and transform a dimming message by performing a signal processing method similar to analog signal processing. It can be seen from FIG. 6 that when the phase-cut angle ANG_pc of the dimmer-adjusted input power signal Pin_C is varied within the range of between the minimum phase-cut angle C1 and the maximum phase-cut angle C2, the voltage level of the dimming control signal Sdc is correspondingly varied within the range of between voltages V1 and V2. So the phase-cut angle ANG_pc of the dimmer-adjusted input power signal Pin_C varied within the dimming range of phase-cut angle is in linear positive correlation with the voltage level of the dimming control signal Sdc. From the perspective of operation of the demodulating circuit 240, when judging that the dimmer-adjusted input power signal Pin_C has the minimum phase-cut angle C1, the demodulating circuit 240 correspondingly converts the dimmer-adjusted input power signal Pin_C to generate a dimming control signal Sdc of the voltage level V1; and similarly, when judging that the dimmer-adjusted input power signal Pin_C has the maximum phase-cut angle C2, the demodulating circuit 240 correspondingly converts the dimmer-adjusted input power signal Pin_C to generate a dimming control signal Sdc of the voltage level V2. Different voltage levels between V1 and V2 can be generated as well based on a conversion performed by demodulating circuit 240 for phase-cut angles between C1 and C2. The different voltage levels V1 and V2 and those therebetween are used to respectively select different lighting control signals Slc. A linear conversion may be carried out using circuitry configured to convert particular phase-cut angles to particular voltage levels (e.g., using a look-up table or other circuitry). As a result, the demodulating circuit 240 may demodulate a modulated, phase-cut, dimmer-adjusted input power signal Pin_C to generate a demodulated signal, such as a constant voltage signal. The demodulating circuit 240 may also be described as a conversion circuit (different from conversion circuit 332), which converts a modulated input signal to an output signal, where the output signal is determined based on the modulated input signal.

Next, the dimming control signal Sdc in linear positive correlation with the phase-cut angle ANG_pc of the dimmer-adjusted input power signal Pin_C is provided to the switching control circuit 331 to cause the conversion circuit 332 to generate a corresponding driving power signal Sdry for driving the LED module LM and causing it to have a corresponding luminance Lux. In some embodiments, the luminance Lux of the LED module LM is in linear negative correlation with the voltage level of the dimming control signal Sdc. As shown in FIG. 6, when the dimming control signal Sdc received by the switching control circuit 331 has a voltage level Va in the range of between the voltage levels V1 and V2, the switching control circuit 331 adjusts the lighting control signal Slc accordingly to cause the LED module LM to light with a luminance La when being driven by the driving power signal Sdrv. In an embodiment, the luminance La is inversely proportional to the voltage level Va of the dimming control signal Sdc, and can be expressed by, but is not limited to, $$La = \frac{Lmax - Lmin}{V2 - V1} * (V2 - Va) + Lmin.$$

It should be noted that the above described mechanism of generating a dimming control signal Sdc in order to reach a luminance Lux of the lighting LED module LM is only an embodiment to illustrate a signal conversion method, similar to analog signal processing, of how the demodulating circuit 240 obtains or extracts a signal feature, such as the phase-cut angle, of the dimmer-adjusted input power signal Pin_C and then transforms/maps the signal feature into a dimming control signal Sdc for enabling the driving circuit 230 to adjust the luminance Lux of the LED module LM according to the dimming control signal Sdc. But the above described mechanism is not intended to limit the scope of the disclosed invention herein. In some embodiments, the relationship between the dimming control signal Sdc and the phase-cut angle ANG_pc may be a non-linear relationship, such as an exponential relationship. Similarly, the relationship between the dimming control signal Sdc and the luminance Lux may be a non-linear relationship. Although the disclosed invention herein is not limited to any of the described relationship herein. In some embodiments, the relationship between the phase-cut angle ANG_pc and the voltage level of the dimming control signal Sdc may be a negative correlation. And In some embodiments, the relationship between the luminance La and the voltage level Va may be a positive correlation.

Referring to FIGS. 3, 4, and 7, the demodulating circuit 240 of this embodiment of FIG. 7 is configured to obtain and transform a dimming message by performing a signal processing method similar to digital signal processing. Specifically, when the phase-cut angle of the modulated input power signal Pin_C is adjusted/varied in a dimming phase range (which also can be referred to as a default phase range), the dimming control signal may have a default number of different signal states corresponding to variations or values of the phase-cut angle, in order to control dimming of the LED module to the default number of different dimming levels respectively. It can be seen from FIG. 7 that when the phase-cut angle ANG_pc of the dimmer-adjusted input power signal Pin_C is varied within the range of between the minimum phase-cut angle C1 and the maximum phase-cut angle C2, the dimming control signal Sdc can have 8 different signal states D1-D8 according to variation of the phase-cut angle ANG_pc. So the dimming range of between the minimum phase-cut angle C1 and the maximum phase-cut angle C2 may be divided into 8 sub-ranges among which the phase-cut angle ANG_pc can be varied and corresponding to the 8 different signal states D1-D8 of the dimming control signal Sdc respectively. In some embodiments, the different signal states of the dimming control signal Sdc may be indicated or represented by different voltage levels, wherein for example the signal state D1 of the dimming control signal Sdc corresponds to a voltage level of 1V and the signal state D8 corresponds to a voltage level of 5V. In some embodiments, the different signal states of the dimming control signal Sdc may be indicated or represented by logical voltage levels coded in multiple bits, wherein for example the signal state D1 of the dimming control signal Sdc corresponds to a logical voltage level coded as the three-bit "000" and the signal state D8 corresponds to a logical voltage level coded as the three-bit "111". The dimming control signal Sdc may be used to control a pulse-width modulation, for example, of the lighting control signal Slc that controls the switching circuit PSW.

Next, the dimming control signal Sdc in the range of the 8 different signal states D1-D8 is provided to the switching control circuit 331 to cause the conversion circuit 332 to generate a corresponding driving power signal Sdry for driving the LED module LM and causing it to have a corresponding luminance Lux. In some embodiments, different values of the luminance Lux of the LED module LM are in one-to-one correspondence with the 8 different signal states D1-D8. As shown in FIG. 7, in this embodiment the 8 different signal states D1-D8 correspond to 100%, 87.5%, 75%, 62.5%, 50%, 37.5%, 25%, and 10% of the maximum value Lmax of the luminance Lux respectively. It's noted that the described embodiment of logical voltage level representation uses three bits to code the distinguishability of the 8 different signal states D1-D8 of the dimming control signal Sdc produced by the demodulating circuit 240, which is also known as an 8-section dimming, but the present invention disclosed herein is not limited to this number of bits. The dimming control signal Sdc may control the lighting control signal Slc, which in turn causes the conversion circuit 332 to generate a corresponding driving power signal Sdrv.

Figure 8:
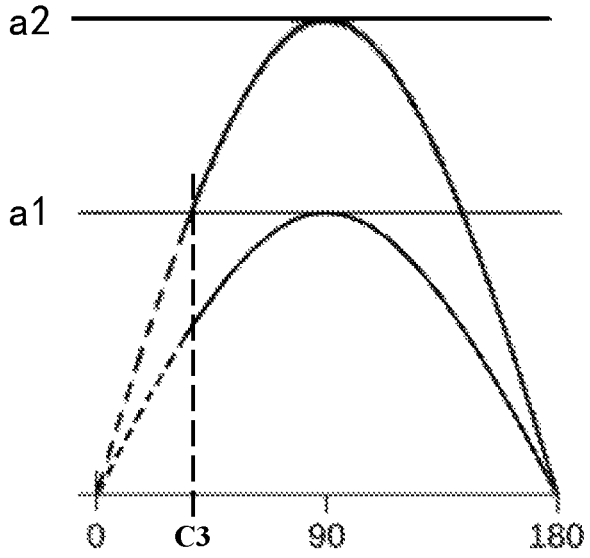
FIG. 8 is a signal waveform diagram of signal waveforms of input power signal of an LED lighting apparatus under different power grid voltages according to an embodiment of the disclosure.

FIG. 8 is a signal waveform diagram of signal waveforms of input power signal of an LED lighting apparatus under different power grid voltages according to an embodiment of the disclosure. Referring to the FIGS. 1A, 3, and 8, it can be seen that no matter whether the peak voltage or amplitude of the input power Pin is a1 or a2, if the dimmer 80 modulates the input power Pin to result in a phase-cut angle C3, the phase angle/interval of the zero voltage level in the dimmer-adjusted input power Pin_C (i.e. the phase angle between 0 degree and C3) generated by the dimmer 80 is the same. Therefore, no matter what the peak voltage or amplitude of the input power Pin is, the demodulating circuit 240 can demodulate any dimmer-adjusted input power Pin_C of the same phase-cut angle to produce the same dimming control signal Sdc. Therefore, no matter what the voltage amplitude of the external power grid EP supplying the LED lighting system 10 is, upon receiving the same dimming signal DIM, the LED lighting system 10 can cause the LED lighting apparatus 100 to light with the same luminance or color temperature, and thus the LED lighting system 10 is compatible with various applications with different types of external power grid EP. In this manner, the dimming level of the LED module is not substantially affected by changes in the peak voltage of the input power signal or by an effective value of the input power signal. Also, the dimming level of the LED module is not directly proportional to an effective value of the input power signal.

From another perspective, in this disclosure, dimming of an LED module (with respect to e.g. its luminance or color temperature) is performed or achieved in response to the cut-off phase angle of the modulated input power signal Pin_C, but largely not in response to the peak voltage or amplitude of the external power grid (as EP).

In contrast, if adopting the described way of dimming control illustrated by FIG. 2, since the effective value of the dimmer-adjusted input power Pin_C even of the same phase-cut angle significantly varies according to different voltage amplitudes of types of applied input power, the described way of dimming control illustrated by FIG. 2 can only be customized or designed specifically for the actual application environment of an LED lighting system 10, which resulting design is not compatible with different types of applied input power.

It should be noted that in practice non-ideal conditions or situations often exist due to intrinsic parasitic effects and mismatches between electronic components. Therefore, although it's intended/desirable that dimming of the LED module is performed not in response to the peak voltage or amplitude of the external power grid, in practice the effects of dimming in embodiments of the present invention may still be somewhat in response to the peak voltage or amplitude of the external power grid. So, according to this disclosure, it may be acceptable that dimming of the LED module is somewhat in response to the peak voltage or amplitude of the external power grid due to such non-ideal conditions or situations. These allowable practical effects and response to the peak voltage or amplitude of the external power grid are referred to herein as being "largely" or "substantially" not in response to the peak voltage or amplitude of the external power grid or are referred to by describing power signals or voltage levels as being "substantially or roughly the same". And the above mentions of "somewhat" in one embodiment may each refer to the low degree of response that dimming of the LED module is impacted or affected, for example, by only less than 5% even when the peak voltage or amplitude of the external power grid is doubled.

Figure 9:
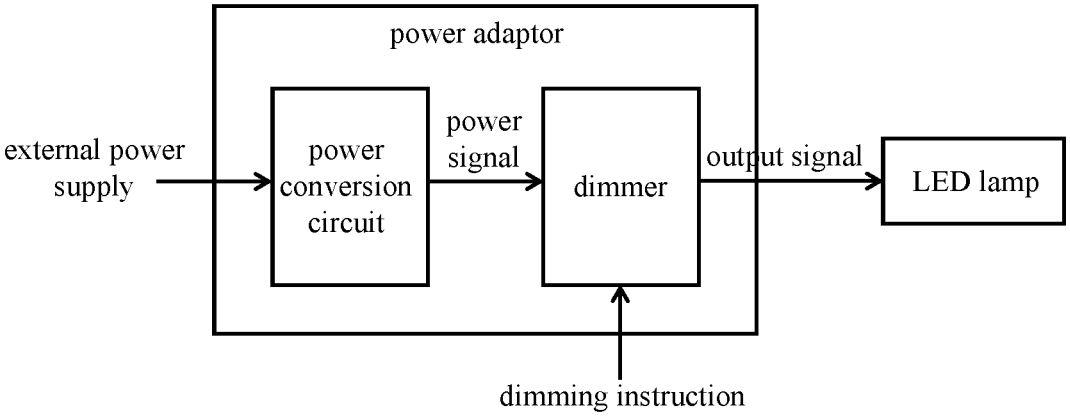
FIG. 9 is a diagram to illustrate a method of controlling an LED lamp according to an embodiment.

FIG. 9 is a diagram to illustrate a method of controlling an LED lamp according to an embodiment. As shown in FIG. 9, a dimmer as in a power adaptor for an LED lamp is configured to receive a power signal and a dimming instruction, and configured to adjust or modulate the power signal, according to the dimming instruction, to produce an output signal, wherein the adjusting or modulating may include for example processing by combining or synthesizing the power signal and the dimming instruction to produce the output signal. The power signal may be a constant DC signal, produced by converting an external power supply such as an AC powerline, and may not encompass a (pulsating) DC signal of relatively high and low voltage levels. In some embodiments the dimming instruction may be converted into a dimming signal including a control code, which comprises a square wave of a specific sequence of high/low voltage levels for providing a way of controlling the LED lamp. Upon receiving the output signal, on the one hand the DC component in the output signal can provide electrical energy for driving the LED lamp to emit light, and on the other hand the LED lamp is configured to perform control of itself according to the way of controlling provided by the control code in the output signal, wherein the performed control of itself refers to for example controlling its luminance and/or color temperature.

Since changing the strength or magnitude of a current output by a driving circuit for an LED unit can adjust the luminance of an LED lamp including the LED unit, in some embodiments of the present invention, the control code of a dimming signal as described above may be a code into which a message of luminance or current strength is converted according to predefined correspondence rules, such as 10% of a maximum luminance corresponding to a control code "001", 50% of a maximum luminance corresponding to a control code "010", and 100% of a maximum luminance corresponding to a control code "100". Upon receiving the output signal including or indicating the control code, the LED lamp demodulates the output signal to obtain a message of luminance corresponding to the control code, to enable a driving module in the LED lamp to perform an adjusting operation (such as adjusting the duty cycle of a power switch) according to the luminance message, thereby realizing adjusting luminance of the LED lamp using the above dimming instruction. For an LED lamp having three color components, luminance of each of the three color components may be separately adjusted when adjusting the color temperature of the LED lamp.

Specific detailed contents of the control code may preferably or in some embodiments include a validation code, an address code, and/or a data code. A function of the validation code may be for the LED lamp to determine or validate (whether) to enter into a control stage. Because there are numerous reasons that can each cause sudden or extreme change or deviation in the power signal and its voltage level, in order to avoid a misjudgment by the LED lamp that such extreme change or deviation is intended to control the LED lamp, it's useful to adopt or use a validation code comprising a waveform expressed by high and low voltage levels which waveform is different from each of waveforms which such extreme change or deviation is likely to produce, such as a validation code 101010 or a series of alternating high and low voltage levels, or each of other combinations of high and low voltage levels.

A function of the address code may be for choosing or selecting one or more LED lamps that is intended to be controlled, or for determining or validating which of a plurality of LED lamps is/are intended to be controlled, or for determining or validating whether each of the LED lamps is to be controlled. For example, suppose there are ten LED lamps connected in parallel and each of the ten LED lamps has a distinct or fixed address number; if the first of the ten lamps is to be controlled, the address code may comprise 0000000001; and if the lamps number 1, 3, 5, 7, and 9 of the ten lamps are to be controlled, the address code may comprise 0101010101. Certain circuit(s) in the LED lamps operate, according to the lamp numbers respectively of the 10 LED lamps (such as a first lamp being assigned number 0, a second lamp being assigned number 1, and an N-th lamp being assigned number N−1), to identify or determine whether the data or contents of the digit or lamp number of each of the 10 LED lamps in the address code is a 1 or 0, such as the address code 0000000001 having the data 1 at the digit or lamp number 0 for the first lamp of the 10 LED lamps. For example, if it's determined that the data of the digit for the first lamp of the 10 LED lamps in the address code is 1, then it's determined that the first lamp of the 10 LED lamps is to be controlled. A simple way of coding for realizing the function of the address code for the ten LED lamps is to use a 10-digit binary coding system to form the address number of each of the 10 lamps, the address number comprising 10 digits wherein the digit of the data 1 corresponds to the integer lamp number of each of the 10 lamps, such as the first lamp having the address number 0000000001, and the second lamp having the address number 0000000010. And an "AND" operation may be performed between each address code and the address number of each of the 10 lamps, to determine or validate which of the 10 LED lamps is/are intended to be controlled. If the result of the "AND" operation between corresponding digits respectively of each address code and an address number and representing a particular lamp of this address number is positive or non-zero, then the particular lamp of the 10 lamps is intended to be controlled; but if the result is negative or a data zero, then the particular lamp having this address number is not intended to be controlled.

As mentioned above, changing the strength or magnitude of a current output by a driving circuit for an LED unit can adjust the luminance of an LED lamp including the LED unit. Thus, a function of the data code of the control code may be to provide an indication of the strength or magnitude of the current. A correspondence relationship between data codes and current magnitudes may be set or arranged in advance, for an LED lamp to determine or locate a magnitude of current corresponding to a received data code according to the correspondence relationship and then to adjust the magnitude of current output by a driving circuit for an LED unit of the LED lamp according to the determined magnitude of current.

If the external power supply for the LED lamp is relatively stable or some external equipment(s) is used to make the power supply stable, the validation code may not be used or needed. Besides, if only one LED lamp is to be controlled, the address code may not be needed.

Figure 10:
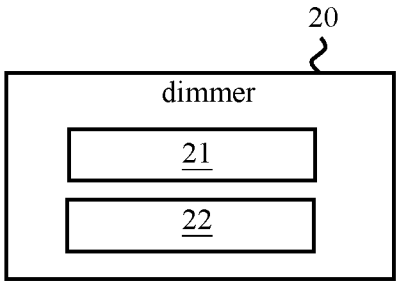
FIG. 10 is a diagram of a basic structure of a dimmer according to an embodiment.

FIG. 10 is a diagram of a basic structure of a dimmer 20 according to an embodiment. As shown in FIG. 10, the dimmer 20 according to this embodiment of the present invention includes mainly a dimming signal generating module 21 and a signal combining processing module 22. The dimming signal generating module 21 is configured to receive a dimming instruction as described above and to transform/convert the dimming instruction into a dimming signal including or carrying a control code as described above. The signal combining processing module 22 is configured to adjust or modulate a power signal (as described above), according to or using the dimming signal, to produce an output signal. Accordingly, it may be that the power signal and the dimming signal are combined or synthesized to produce the output signal.

Because a control code included in a dimming signal of certain embodiments comprises a square wave of a specific sequence of high/low voltage levels, in some embodiments of the present invention the variation/transition between the high and low voltage levels along the sequence can be implemented by adopting the method of alternating conducting of a current either through or bypassing an impedance network or circuit that can produce a voltage drop when the current is passing through the impedance circuit. According to the needs of actual lighting effects of an LED lamp, a way of controlling may be determined or set in advance, such as a way of controlling an individual or single LED lamp to light or to darken or be turned off in a particular order or sequence, or a way of controlling a plurality of LED lamps to light according to a particular pattern or rule. A way of controlling may be expressed by a sequence of bits or binary digits of 0/1 and stored in a storage device, wherein the stored way of controlling may be read from the storage device in order to form a dimming signal as described above for operating the LED lamp(s).

Figure 11:
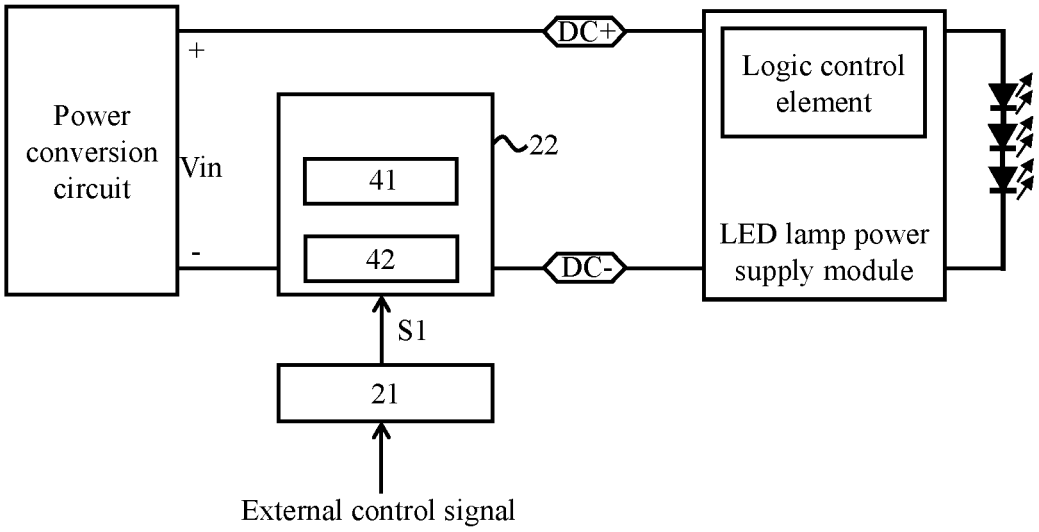
FIG. 11 is a circuit block diagram of a power adaptor including a dimmer according to an embodiment.
Figure 12:
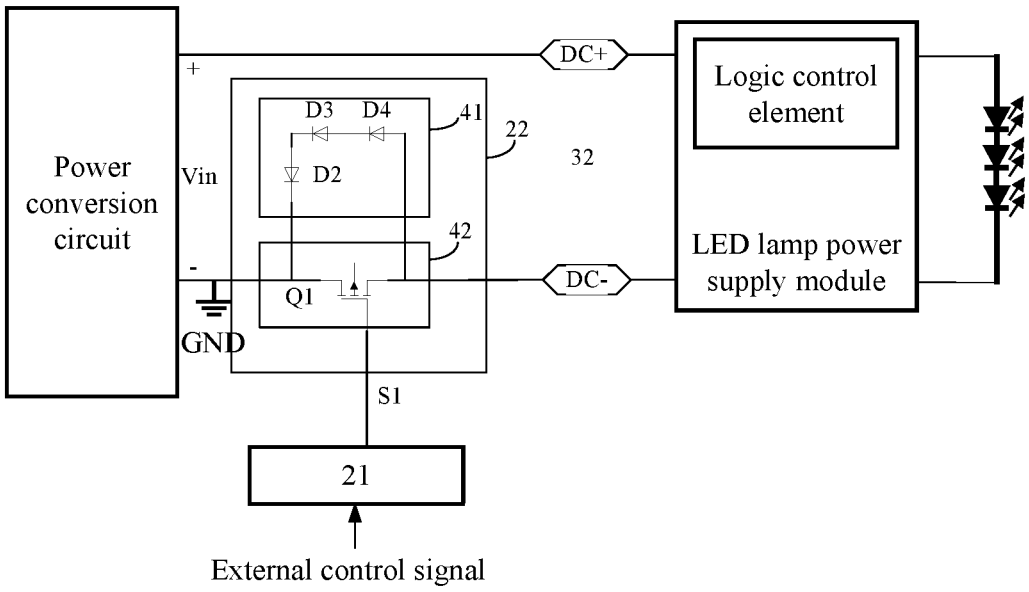
FIG. 12 is a circuit block diagram of an adaptor according to an embodiment.

Next, technical solutions of the present invention are further described in the concrete exemplary circuit-structure embodiments below. FIG. 11 illustrates a circuit block of a power adaptor according to an embodiment including a dimmer used with a power conversion circuit in order to supply LED lamp(s). As shown in FIG. 11, an external dimming instruction may be input to a dimming signal generating module 21 (also described as a dimming signal generating circuit) of the dimmer and then converted into a dimming signal S1 including a control code, which is then input to a control unit 42 (also described as a control circuit) of a signal combining processing module 22 of the dimmer. A voltage division unit 41 (e.g., voltage division circuit) of the signal combining processing module 22 is serially connected on a power path in the dimmer. A specific circuit structure of the signal combining processing module 22 of FIG. 11 is illustrated in FIG. 12. FIG. 12 is a circuit block diagram of an adaptor including a specific circuit-structure embodiment of the signal combining processing module 22 of FIG. 11. In FIG. 12, the voltage division unit 41 has a terminal connected to ground (GND) and another terminal acting as a negative terminal (DC−) of the dimmer; and the control unit 42 is configured to control voltage division performed by the voltage division unit 41 or to cause the voltage division unit 41 to be bypassed by an electrical current.

FIG. 12 presents an optional specific circuit structure of the control unit 42 and the voltage division unit 41 of the signal combining processing module 22. As shown in FIG. 12, the voltage division unit 41 includes diodes D2, D3, and D4 connected anode-to-cathode in series to form a set of diodes, wherein the anode of the diode D4 and the cathode of the diode D2 act as an input terminal and an output terminal of the diode set respectively. The control unit 42 includes a switch Q1 such as a thyristor or transistor, which has a first terminal connected to the output terminal of the diode set and has a second terminal connected to the input terminal of the diode set. A control terminal of the switch Q1 is configured to receive the dimming signal S1. It can be seen that when the switch Q1 is turned or switched off, the diode set becomes serially connected on a power path or power loop in the dimmer; but when the switch Q1 is turned or switched on, the diode set becomes bypassed as by a current flowing through the turned-on switch Q1, so the current flows outside of the power path or power loop. The type of the switch Q1 to be used may be appropriately selected according to practical needs, as long as its conducting state and/or cutoff state can be controlled according to the dimming signal so as to cause the diode set to become serially connected on the power path or bypassed as by a current flowing through the power path.

Figure 13:
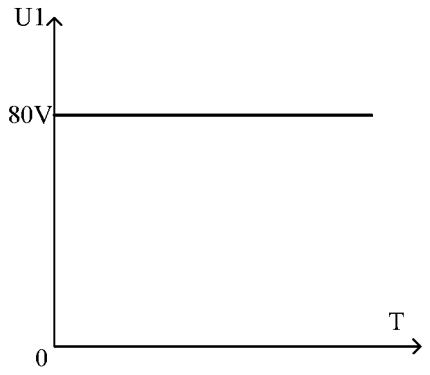
FIG. 13 is a waveform diagram of a power signal according to an embodiment.

FIG. 13 is a waveform diagram of a power signal according to an embodiment. According to the above description, upon an external power supply being connected to the power conversion circuit in FIG. 12, a switch Q1 may be used and switched on/off to control a voltage drop along the diode set or across the input and output terminals of the diode set of FIG. 12. Specifically, in some embodiments, when the dimming signal S1 is at a (relatively) high voltage level, the switch Q1 is conducted to pull down (to almost 0 volt) the voltage drop across its input and output terminals, causing a signal output at the output terminal 32 of the dimmer to be substantially the same as or very similar to a DC signal U1 input by the power conversion circuit of FIGS. 11 and 12. The DC signal U1 may well be a rectified signal produced by the power conversion circuit performing rectification on an external power supply such as an AC powerline, and may have a waveform as shown in FIG. 13 of a horizontal line meaning a substantially constant DC signal. On the other hand, when the dimming signal S1 is at a (relatively) low voltage level, the switch Q1 is cut off or turned off, causing a current flowing on the power path or power loop to flow through the diode D4, diode D3, and diode D2 in sequence and then to the ground GND, instead of flowing through the switch Q1. Since the voltage drop across a diode when conducting a current is generally about 0.7V, the total voltage drop across the voltage division unit 41 comprising the diode set of the three diodes D4, D3, and D2, when a current is conducted by the diode set, is about 2V, thus producing an output voltage of (U1−2) V at the output terminal 32 of the dimmer 20. A voltage drop along part of the diode set or across the voltage division unit 41 may be referred to as a division voltage produced by the voltage division unit 41.

It can be seen from the previous description of embodiments of FIGS. 11-13 that the control unit 42 and the voltage division unit 41 are configured to combine or synthesize an output signal of the power conversion circuit and a dimming signal S1, in order to produce variation(s) or transition(s) between high and low voltage levels on an output signal at the output terminal 32 of the dimmer 20. Next, the process of synthesizing the signals is further described with reference to exemplary signal waveforms in some figures introduced below.

Figure 14:
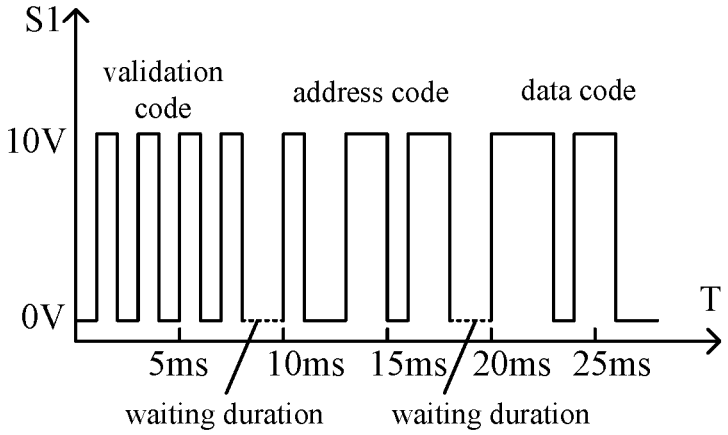
FIG. 14 is a signal waveform diagram of a signal for controlling a thyristor according to an embodiment.
Figure 15:
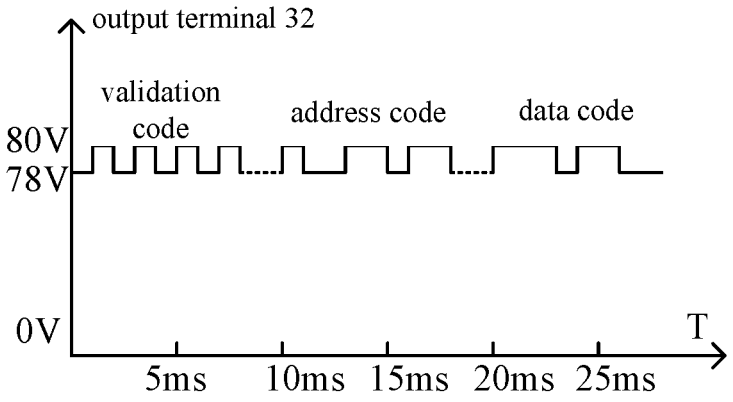
FIG. 15 is a waveform diagram of an output signal according to an embodiment.

FIG. 14 is a signal waveform diagram of a dimming signal S1 for controlling a switch Q1 according to an embodiment. As illustrated in FIG. 14, with reference to at least FIG. 12, the dimming signal S1 applied to the control terminal of the switch Q1 includes for example a validation code 01010101, an address code 10011011, and a data code 11101100, which three codes may be separated by no-code or waiting durations on the dimming signal S1. After the process described above is performed, the signal waveform at the output terminal 32 of the dimmer 20 is as illustrated in FIG. 15. FIG. 15 is a waveform diagram of an output signal at the output terminal 32 of the dimmer according to an embodiment. It can be seen from FIG. 15 that in this embodiment a DC signal U1 of a voltage of 80V from a power conversion circuit as in FIG. 12, after passing through the control unit 42 while bypassing the 3-diode set (of the voltage division unit 41), or passing through and undergoing voltage division of the 3-diode set, the switching between the two conduction paths being determined by an input dimming signal S1, results in an output signal at the output terminal 32 having a high voltage level of 80V as well and a low voltage level of about 78V, meaning a division voltage of about 2V (=80−78) due to passing through the 3-diode set of the voltage division unit 41.

Referring to FIGS. 12 and 14-15, in this embodiment it can be seen that the output signal produced at the output terminal 32 and then input to the LED lamp(s) is no longer a simple constant DC signal as output by the power conversion circuit in FIG. 12, but is now a control signal carrying a validation code, an address code, and a data code. When the LED lamp(s) detects at its input terminal (or the output terminal 32) a validation code of 8 digits, after a waiting duration it detects or receives an address code of 8 digits on the output signal. If this address code matches the address number of the LED lamp(s), after a waiting duration (upon receiving the address code) the LED lamp(s) detects or receives a data code of 8 digits on the output signal, and then according to a translation of the received data code by a demodulation circuit the LED lamp(s) uses its driving circuit, the demodulation circuit, etc., in its power supply module to perform adjusting of its luminance and/or color temperature. It's noted that the LED lamp(s) may comprise either a plurality of LED lamps, or a single LED lamp. An exemplary circuit block structure of a power supply module 80 of an LED lamp is shown in FIG. 16 according to an embodiment.

From the above descriptions respectively of the embodiments of FIGS. 3-8 and the embodiments of FIGS. 11-15, a significant difference may be that in the embodiments of FIGS. 3-8 dimming control is performed by applying a dimmer 80 (e.g. in a power adaptor) to an external power supply EP normally comprising an AC powerline in order to produce an input power signal Pin_C, while in the embodiments of FIGS. 11-15 dimming control is performed by using a dimmer 20 configured to receive a DC power signal (as from a power conversion circuit) and to adjust or modulate the DC power signal in order to produce an output signal for dimming control.

Figure 16:
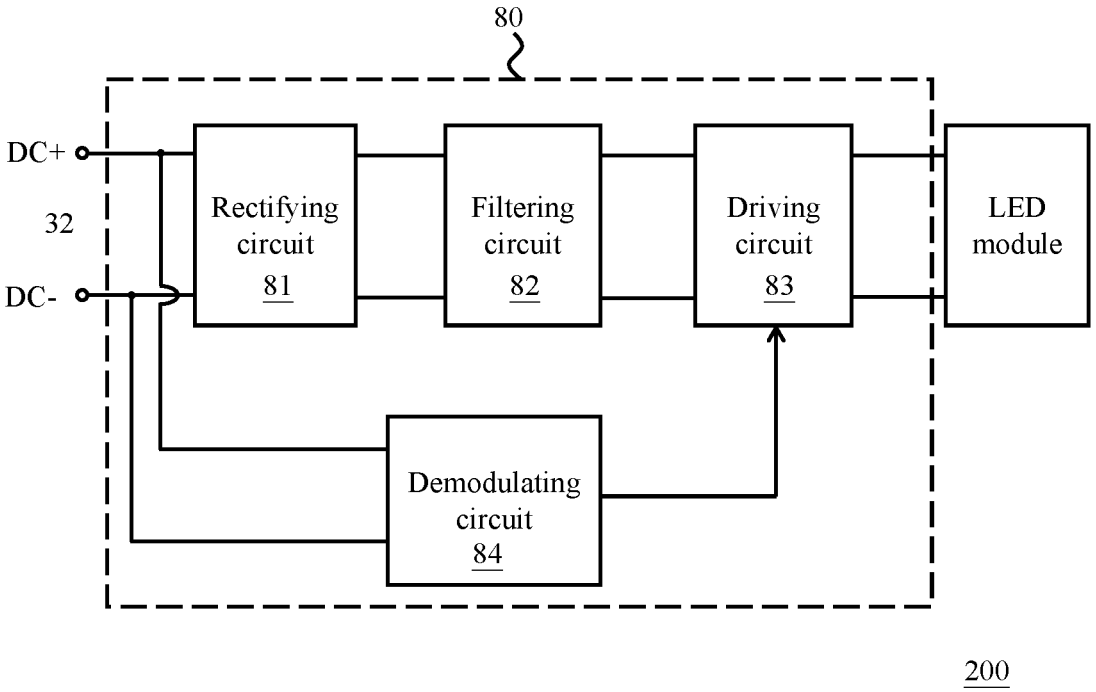
FIG. 16 is a block diagram of a power supply module of an LED lamp according to an embodiment.

As shown in FIG. 16, the power supply module 80 is coupled to an output terminal 32 of the dimmer as in FIG. 11 or 12, and includes a rectifying circuit 81, a filtering circuit 82, a driving circuit 83, and a demodulating circuit 84. Since a power adaptor for some types of LED lamps is disposed external to the LED lamp, the rectifying circuit 81 and the filtering circuit 82 may instead be disposed in the external power adaptor, so the power supply module 80 may or may not include a rectifying circuit 81 and a filtering circuit 82. The demodulating circuit 84 may be embodied by an integrated circuit, and is configured to demodulate or translate the control code of the output signal at the output terminal 32 and then provide a reference voltage for the driving circuit 83, which is configured to adjust luminance or color temperature of the LED lamp according to the reference voltage.

If a user of the LED lamp(s) is not to control the luminance or color temperature of the LED lamp, the LED lamp will operate according to its conventional way(s) of operation. So an LED lamp may have two available modes of operation, for which capability a switching device (not illustrated in FIG. 16) may be disposed at the output terminal 32 and configured to switch for realizing either of the two modes of operation available to a user, in which modes are respectively to control and not to control the luminance or color temperature of the LED lamp. When the user chooses to control the luminance or color temperature of the LED lamp, the switching device may operate to conduct an external power supply signal into a rectifying circuit 81 of FIG. 16 or expressly into a driving circuit 83 if a rectifying circuit 81 is not present. On the other hand, when the user chooses not to control the luminance or color temperature of the LED lamp, the switching device may operate to conduct an external power supply signal into a demodulating circuit 84 instead. No matter whether to adjust or control the luminance or color temperature of the LED lamp, it's still the driving circuit 83 as in FIG. 16 that is configured to drive the LED module.

A dimmer for adjusting the luminance or color temperature of LED lamp(s) according to embodiments of the present invention may be disposed in a power adaptor for the LED lamp(s), which typically has a function of transforming AC power into DC power. In such a case, current or conventional LED lamps can conveniently perform adjusting or controlling of its luminance or color temperature by merely adopting or being supplied by a power adaptor in which a dimmer according to embodiments of the present invention is disposed. For new types of LED lamps to be produced, such a dimmer may be disposed in the LED lamp. For an LED lighting system including a plurality of LED lamps to be produced, such a dimmer may be disposed in a power adaptor for one or more of the LED lamps, wherein an external dimming instruction includes an address code for choosing or locating one or more of the plurality of LED lamps that is to be controlled.

According to the disclosed technical solutions herein in embodiments of the present invention, a dimming instruction comprising a signal of high/low voltage levels may be added or introduced on the basis of a DC power supply signal for LED lamp(s), in order to enable the LED lamp(s) to adjust or control its luminance and/or color temperature of itself according to the dimming instruction. The introduction of such a dimming instruction may be realized by adopting a dimmer according to embodiments of the present invention, which dimmer may be disposed in a power adaptor for the LED lamp(s) or inside the LED lamp(s). Therefore, by adopting the disclosed technical solutions of embodiments of the present invention, in one aspect the function of light dimming in a current LED lamp can be achieved without having to modify its original structure(s) wherein the current LED lamp originally does not have the function; and in another aspect dimming control of a plurality of parallel-connected LED lamps can be conveniently or better achieved.

For a user to be able to choose his preferred or liked luminance and/or color temperature of the LED lamp(s), an initial dimming instruction may be given by the user, whose detailed implementation may include selecting the LED lamp(s) to be controlled and/or his preferred luminance and/or color temperature of the LED lamp(s) under control by pressing button(s) on a remote control unit or by operating a user-machine interface of an application software run on a mobile phone. As to selecting a luminance, it can be selected in terms of a percentage of the maximum luminance or brightness; or it can be selected by directly inputting a percentage value; or it can be selected among fixed different degrees on a scale. For a user to select his preferred color temperature of the LED lamp(s), it can be selected among fixed different degrees on a scale, which selection by the user may be processed by a modulation circuit to generate an external control signal as in FIG. 11.

Figure 17:
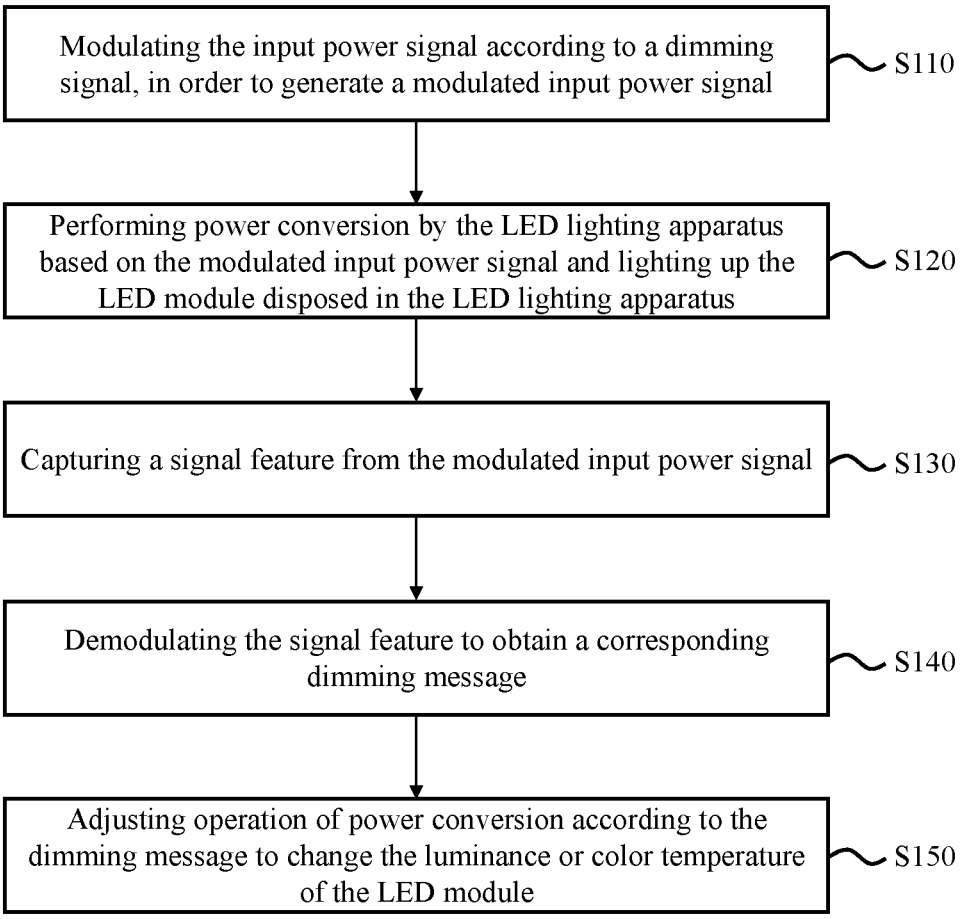
FIG. 17 is a flow chart of steps of a dimming control method for an LED lighting system according to an embodiment of the disclosure.

FIG. 17 is a flow chart of steps of a dimming control method for an LED lighting system according to an embodiment of the disclosure. Referring to both FIGS. 1A and 17, a whole dimming control method is described here from the perspective of the LED lighting system 10. First, the dimmer 80 modulates the input power Pin according to a dimming signal DIM, in order to generate a dimmer-adjusted input power signal Pin_C (step S110), wherein the dimmer-adjusted input power signal Pin_C carries a signal feature indicative of a dimming message, which the signal feature is for example a phase-cut angle or phase conduction angle of the dimmer-adjusted input power signal Pin_C. The dimmer-adjusted input power signal Pin_C is then provided to the LED lighting apparatus 100, causing the LED lighting apparatus 100 to perform power conversion and light up the internal LED module according to the received input power Pin_C (step S120). On the other hand, the LED lighting apparatus 100 captures or extracts a signal feature of the received input power Pin_C (step S130), and then demodulates the signal feature to obtain a corresponding dimming message (step S140). And then the LED lighting apparatus 100 adjusts operation of power conversion according to the demodulated dimming message, in order to change/adjust the luminance or color temperature of the LED module (step S150).

Referring to FIGS. 3 and 17, the step of obtaining a signal feature of the received input power Pin_C (step S130), and the step of demodulating the received input power Pin_C (step S140) may be performed or achieved by a demodulating circuit 240 in the LED lighting apparatus 100/200. And the step of causing the LED lighting apparatus 100 to perform power conversion and light up the internal LED module according to the received input power Pin_C (step S120), and the step of adjusting operation of power conversion according to the demodulated dimming message in order to adjust the luminance of the LED module (step S150) may be performed or achieved by a driving circuit 230 in the LED lighting apparatus 100/200. As a result, when only a small range of phase-cut angles are used to create the dimmer-adjusted input power signal Pin_C, the luminance of the LED module may be affected in small part based on a direct power conversion, but may be affected in large part, and primarily, based on the control according to the output of the demodulating circuit 240, which, for example, can instruct the driving circuit 230 to perform additional dimming.

Figure 18:
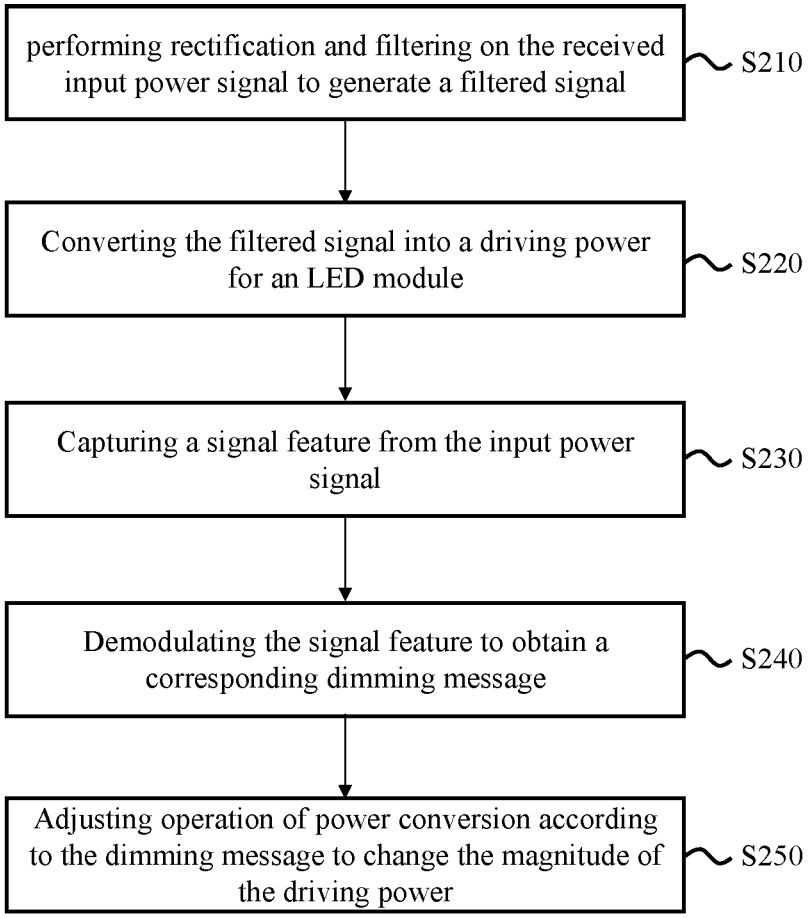
FIG. 18 is a flow chart of steps of a dimming control method for an LED lighting apparatus according to an embodiment of the disclosure.

Next a further description of a whole dimming control method from the perspective of the LED lighting apparatus 100 is presented with reference to FIG. 18. FIG. 18 is a flow chart of steps of a dimming control method for an LED lighting apparatus according to an embodiment of the disclosure. Referring to FIGS. 1A, 3, and 18, when the LED lighting apparatus 100 receives an input power Pin_C, a rectifying circuit 210 and a filtering circuit 220 perform a rectification and a filtering on the received input power Pin_C respectively in order to generate a filtered signal Sflr for a driving circuit 230 (step S210). The driving circuit 230 then performs power conversion on the received filtered signal Sflr and then generates a driving power signal Sdry for a later-stage LED module (step S220). On the other hand, a demodulating circuit 240 captures or extracts a signal feature of the received input power Pin_C (step S230), and then demodulates the signal feature to obtain a dimming message and generate a corresponding dimming control signal Sdc (step S240). And the driving circuit 230 adjusts operation of power conversion according to the dimming control signal Sdc, in order to adjust the magnitude of the driving power Sdry in response to the obtained dimming message (step S250), for adjusting/changing the luminance or color temperature of the LED module LM. In this case as well, as a result, when only a small range of phase-cut angles are used to create the input power signal Pin_C, the luminance of the LED module may be affected in small part based on a direct power conversion, but may be affected in large part, and primarily, based on the control according to the output of the demodulating circuit 240, which, for example, can instruct the driving circuit 230 to perform additional dimming.

Further, in some embodiments, a way to adjust power conversion operation of a driving circuit 230 by using a dimming control signal Sdc may be an analog-signal control method. For example, the dimming control signal Sdc may be an analog signal used to control a reference value of voltage or current of the driving circuit 230 in an analog way, so as to adjust the magnitude of the driving power signal Sdry in an analog way.

While in some embodiments, a way to adjust power conversion operation of a driving circuit 230 by using a dimming control signal Sdc may be a digital-signal control method. For example, the dimming control signal Sdc may control the driving circuit to have different duty cycles corresponding to variations or values of the phase-cut angle respectively. In such embodiments, the dimming control signal Sdc may be a digital signal having a first state (as a high logical state) and a second state (as a low logical state), or may have a plurality of additional states (e.g., 8 total states). In one embodiment, the first state and the second state may be used to control the magnitude of the driving power signal Sdry of the driving circuit 230 in a digital way, such that at the first state of the dimming control signal Sdc the driving circuit 230 outputs a current while at the second state of the dimming control signal Sdc the driving circuit 230 stops outputting a current, for performing dimming of the LED module LM. If more than 2 states are used, the different states can be used to control a duty cycle of the driving power signal Sdry of the driving circuit 230.

Figure 19:
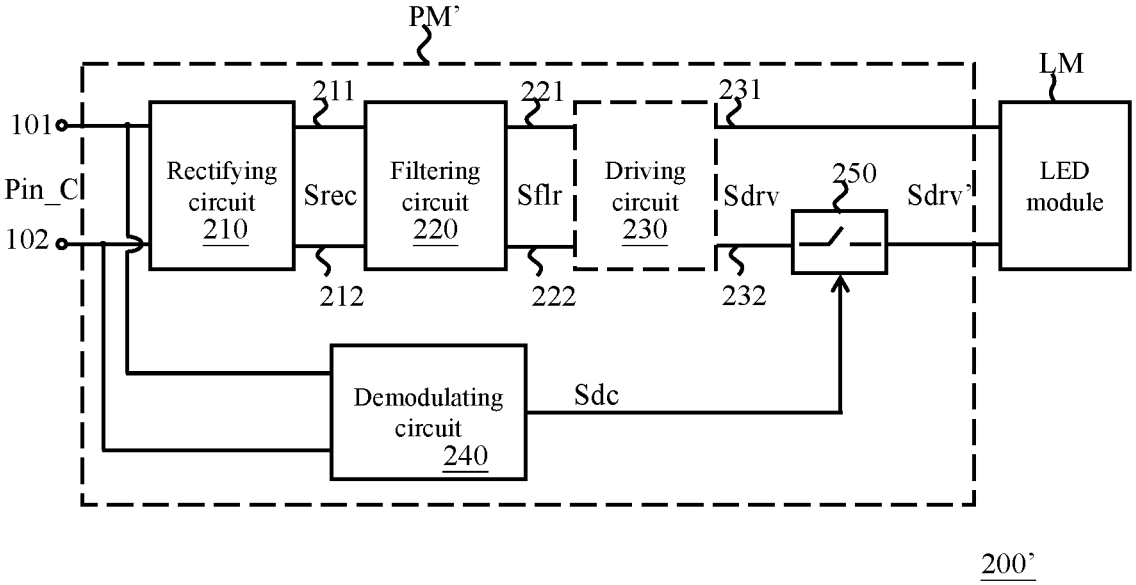
FIG. 19 is a circuit block diagram of an LED lighting apparatus according to another embodiment of the disclosure.

In some embodiments, dimming control of the LED module LM may be performed by controlling a circuit external to a driving circuit 230. For example, referring to FIG. 19, the embodiment of the LED lighting apparatus 200' shown in FIG. 19 is similar to that of FIG. 3 with a difference that in this embodiment of FIG. 19 a power supply module PM' further includes a dimming switch 250, configured for conducting or cutting off the driving power signal Sdry according to the dimming control signal Sdc so as to generate an intermittent driving power signal Sdrv' upon the dimming control signal Sdc for the LED module LM, for performing dimming of the LED module LM.

Figure 20:
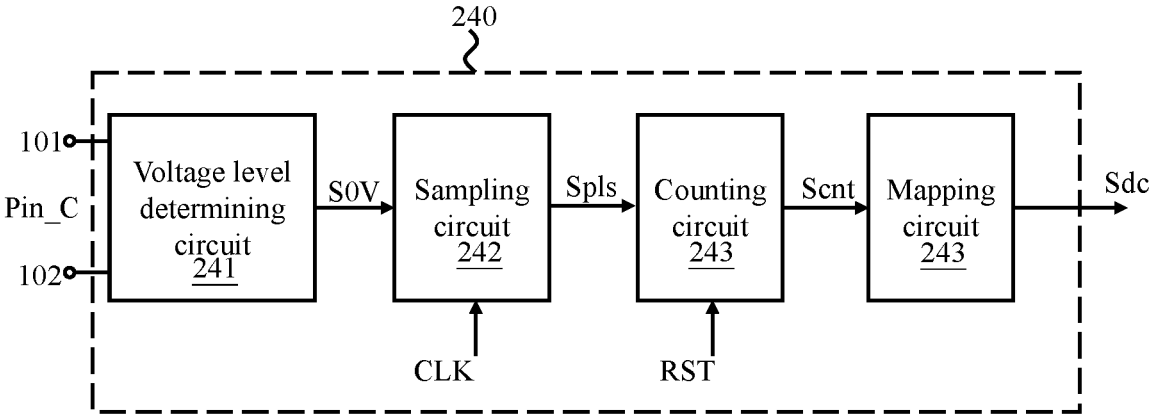
FIG. 20 is a block diagram of an embodiment of a demodulating circuit in an LED lighting apparatus according to an embodiment.
Figure 21:
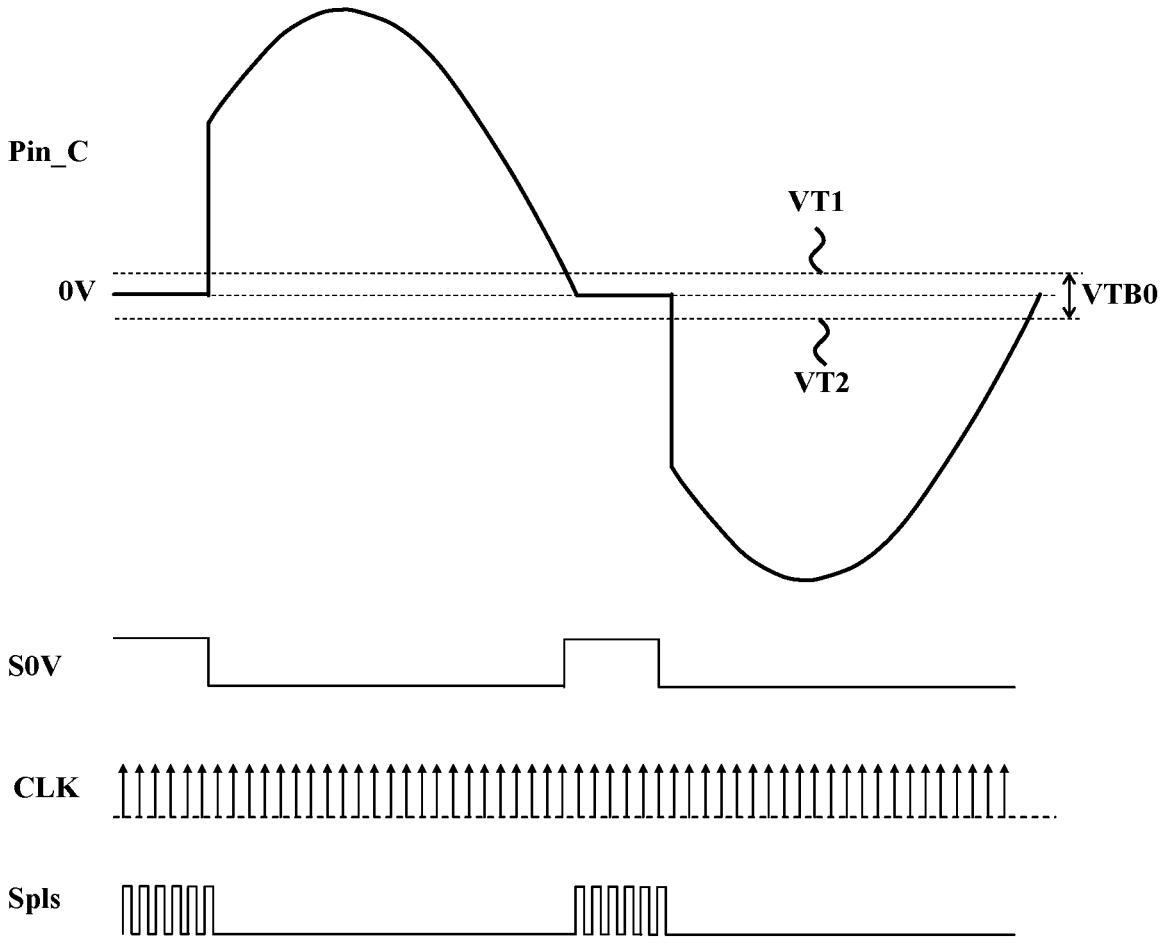
FIG. 21 illustrates correspondence between signal waveforms related to a demodulating circuit in an LED lighting apparatus according to an embodiment.

FIG. 20 is a block diagram of an embodiment of a demodulating circuit (such as the demodulating circuit 240 described herein) in an LED lighting apparatus according to an embodiment. FIG. 21 illustrates correspondence between signal waveforms related to a demodulating circuit in an LED lighting apparatus according to an embodiment. Referring to both FIGS. 20 and 21, a demodulating circuit 240 in FIG. 20 includes a voltage determining circuit 241, a sampling circuit 242, a counting circuit 243, and a mapping circuit 244. The voltage level determining circuit 241 is configured to detect whether (the value or level of) the input power signal Pin_C is in a range of threshold values in order to determine whether the input power signal Pin_C is at a certain voltage level (e.g., zero voltage level). Specifically, as shown in FIG. 21, in some embodiments, the voltage level determining circuit 241 compares the voltage level of the input power signal Pin_C with an upper threshold value Vt1 and a lower threshold value Vt2, in order to determine whether the input power signal Pin_C is in the range of threshold values VTB0. When the input power signal Pin_C is in the range of threshold values VTB0, the voltage level determining circuit 241 outputs a corresponding voltage determination signal S0V having a first logical level (such as a high logical level) to indicate that the input power signal Pin_C is in the range of threshold values VTB0. The sampling circuit 242 is configured to sample the voltage determination signal S0V according to a clock signal CLK, in order to generate a sample signal Spls that may have pulse(s). The sampling may be performed as synchronized with the clock signal CLK. Upon the sampling, as shown in FIG. 21, when the sampled voltage determination signal S0V has or is at a high logical level indicating that the input power signal Pin_C is in the range of threshold values VTB0, the sample signal Spls outputs or presently has one or more pulses. Then, the counting circuit 243 counts the number of pulses on the sample signal Spls, such as during a half (or ½) signal cycle of the input power signal Pin, which is, for example, a sinusoidal voltage signal with frequency of 50 Hz or 60 Hz, in order to generate a counting signal Scnt, and the mapping circuit 244 maps the counting signal Scnt into a dimming control signal (such as the above-described dimming control signal Sdc), based on for example the ratio of the counting signal Scnt (indicative of the number of pulses on the sample signal Spls) to the total number of pulses or impulses on the clock signal CLK during the half signal cycle of the input power signal Pin. In this case, a resetting signal RST in FIG. 21 may be synchronized with the half signal cycle of the input power signal Pin in order to reset the counting circuit 243.

It should be noted that, the dimming control signal Sdc, as described in FIG. 3 or FIG. 4, does not transmit on the power loop which the driving power signal passes through. For example, the dimming control signal Sdc is not used for driving the LED module directly. From another perspective, the current intensity or the power level of the dimming control signal Sdc is much less than the driving power signal Sdrv. In some embodiments, the current intensity or the power level of the driving power signal Sdry is at least 10 times larger than the dimming control signal Sdc.

It should be noted that, although the described embodiments in this disclosure related to modulating the input power to result in a phase cut-off or conduction angle all use the leading edge phase cutting (meaning the phase cutting of the input power signal starts from the phase of 0 degree) for example, the disclosed invention is not limited to this type of phase cutting. In some embodiments, the dimmer can instead use the trailing edge phase cutting, i.e. the phase cutting of the input power signal starts from a particular positive phase to the phase of 180 degrees, as a way to modulate the input power.

It should also be noted that, although the described embodiments in this disclosure all aim to adjust the luminance of the lighting LED module, the described methods in these embodiments can be adapted or analogized for adjusting the color temperature of the lighting LED module. For example, if the described way of dimming control is used for adjusting the driving power for the red-light LED chips, i.e. only the luminance of these red-light LED chips in the LED lighting apparatus is adjusted, the described way of dimming control can achieve the adjusting of color temperature of the LED lighting apparatus.

According to the design of the rectifying circuit in the power supply module, there may be a dual rectifying circuit. First and second rectifying circuits of the dual rectifying circuit are respectively coupled to the two end caps disposed on two ends of the LED apparatus. The dual rectifying circuit is applicable to the drive architecture of dual-end power supply.

The dual rectifying circuit may comprise, for example, two half-wave rectifier circuits, two full-wave bridge rectifying circuits or one half-wave rectifier circuit and one full-wave bridge rectifying circuit.

According to the design of the pin in the LED apparatus, there may be two pins in a single end (the other end has no pin), two pins in corresponding ends of two ends, or four pins in corresponding ends of two ends. The designs of two pins in single end and two pins in corresponding ends of two ends are applicable to a single rectifying circuit design of the rectifying circuit. The design of four pins in corresponding ends of two ends is applicable to a dual rectifying circuit design of the rectifying circuit, and the external driving signal can be received by two pins in only one end or any pin in each of two ends.

According to the design of the filtering circuit of the power supply module, there may be a single capacitor, or π filter circuit. The filtering circuit filers the high frequency component of the rectified signal for providing a DC signal with a low ripple voltage as the filtered signal. The filtering circuit also further comprises the LC filtering circuit having a high impedance for a specific frequency for conforming to current limitations in specific frequencies of the UL standard. Moreover, the filtering circuit according to some embodiments further comprises a filtering unit coupled between a rectifying circuit and the pin(s) for reducing the EMI resulted from the circuit(s) of the LED apparatus. The LED apparatus may omit the filtering circuit in the power supply module when the external driving signal is a DC signal.

The above-mentioned exemplary features of the present invention can be accomplished in any combination to improve the LED apparatus, and the above embodiments are described by way of example only. The present invention is not herein limited, and many variations are possible without departing from the spirit of the present invention and the scope as defined in the appended claims.

What is claimed is:

1. A dimmer comprising a dimming signal generating circuit and a signal combining processing circuit, wherein:

the dimming signal generating circuit is configured to receive a dimming instruction including a control code, which comprises a square wave of a specific sequence of high/low voltage levels for providing a manner of controlling an LED lamp, for the LED lamp to perform control of itself according to the manner of controlling provided by the control code in a received output signal, and the signal combining processing circuit is configured to combine or synthesize a power signal and the dimming instruction to produce the output signal, wherein the power signal comprises a constant direct current (DC), wherein the signal combining processing circuit includes a voltage division circuit and a control circuit, wherein the voltage division circuit has a terminal connected to ground and another terminal acting as a negative terminal of the dimmer; and the control circuit is configured to control voltage division performed by the voltage division circuit or to cause the voltage division circuit to be bypassed by a current.

2. A dimmer comprising a dimming signal generating circuit and a signal combining processing circuit, wherein: the dimming signal generating circuit is configured to receive a dimming instruction including a control code, which comprises a square wave of a specific sequence of high/low voltage levels for providing a manner of controlling an LED lamp, for the LED lamp to perform control of itself according to the manner of controlling provided by the control code in a received output signal, and the signal combining processing circuit is configured to combine or synthesize a power signal and the dimming instruction to produce the output signal, wherein the power signal comprises a constant direct current (DC), wherein the signal combining processing circuit includes a voltage division circuit and a control circuit, wherein the voltage division circuit has a terminal connected to ground and another terminal acting as a negative terminal of the dimmer; and the control circuit is configured to control voltage division performed by the voltage division circuit or to cause the voltage division circuit to be bypassed by a current, and, wherein the voltage division circuit comprises a set of diodes connected anode-to-cathode in series, wherein the anode of a first one and the cathode of a last one of the diode set act as an input terminal and an output terminal of the diode set respectively;

the control circuit comprises a switch, wherein the switch has a first terminal connected to the output terminal of the diode set, a second terminal connected to the input terminal of the diode set, and a control terminal for connecting to an output terminal of the dimming signal generating circuit; and through the input terminal and output terminal of the switch, the control circuit is configured to be serially connected on a power loop from a power conversion circuit to the LED lamp.

3. The dimmer according to claim 2, configured in a power adaptor for the LED lamp.

4. The dimmer according to claim 2, wherein the dimming signal generating circuit includes a signal isolation circuit, which has an output terminal for connecting to the control terminal of the switch and an input terminal for receiving the dimming instruction.

5. The dimmer according to claim 4, wherein the control code includes a data code for the LED lamp to perform control of its luminance and/or color temperature according to the data code.

6. The dimmer according to claim 4, wherein the control code includes a validation code and a data code, for the LED lamp to determine or validate, according to the validation code, to enter into a control stage; and then for the LED lamp to perform control of its luminance and/or color temperature according to the data code.

7. The dimmer according to claim 4, wherein the LED lamp is connected or associated with the dimmer and comprises a plurality of LED lamps, and the control code includes an address code and a data code, for each of the plurality of LED lamps to determine or validate, according to the address code, whether said each LED lamp is to be controlled, and if the determination is positive for said each LED lamp to perform control of its luminance and/or color temperature according to the data code.

8. The dimmer according to claim 4, wherein the LED lamp is connected or associated with the dimmer and comprises a plurality of LED lamps, and the control code includes a validation code, an address code, and a data code, for the plurality of LED lamps to determine or validate, according to the validation code, to enter into a control stage; for each LED lamp to determine or validate, according to the address code, whether said each LED lamp is to be controlled; and if the determination is positive for said each LED lamp to perform control of its luminance and/or color temperature according to the data code.

9. An LED lamp comprising a dimmer, the dimmer comprising a dimming signal generating circuit and a signal combining processing circuit, wherein the dimming signal generating circuit is configured to receive a dimming instruction including a control code, which comprises a square wave of a specific sequence of high/low voltage levels for providing a manner of controlling the LED lamp, for the LED lamp to perform control of itself according to the manner of controlling provided by the control code in a received output signal, and the signal combining processing circuit is configured to combine or synthesize a power signal and the dimming instruction to produce the output signal, wherein the power signal comprises a constant direct current (DC), wherein the signal combining processing circuit includes a voltage division circuit and a control circuit, wherein the voltage division circuit has a terminal connected to ground and another terminal acting as a negative terminal of the dimmer; and the control circuit is configured to control voltage division performed by the voltage division circuit or to cause the voltage division circuit to be bypassed by a current, and wherein, wherein the voltage division circuit comprises a set of diodes connected anode-to-cathode in series, wherein the anode of a first one and the cathode of a last one of the diode set act as an input terminal and an output terminal of the diode set respectively;

the control circuit comprises a switch, wherein the switch has a first terminal connected to the output terminal of the diode set, a second terminal connected to the input terminal of the diode set, and a control terminal for connecting to an output terminal of the dimming signal generating circuit; and through the input terminal and output terminal of the switch, the control circuit is configured to be serially connected on a power loop from a power conversion circuit to the LED lamp.

10. The LED lamp according to claim 9, wherein the dimming signal generating circuit includes a signal isolation circuit, which has an output terminal for connecting to the control terminal of the switch and an input terminal for receiving the dimming instruction, and the control code includes a validation code and a data code, for the LED lamp to determine or validate, according to the validation code, to enter into a control stage; and then for the LED lamp to perform control of its luminance and/or color temperature according to the data code.

11. The LED lamp according to claim 9, wherein the dimming signal generating circuit includes a signal isolation circuit, which has an output terminal for connecting to the control terminal of the switch and an input terminal for receiving the dimming instruction, and wherein the LED lamp is connected or associated with the dimmer and comprises a plurality of LED lamps, and the control code includes a validation code, an address code, and a data code, for the plurality of LED lamps to determine or validate, according to the validation code, to enter into a control stage; for each LED lamp to determine or validate, according to the address code, whether said each LED lamp is to be controlled; and if the determination is positive for said each LED lamp to perform control of its luminance and/or color temperature according to the data code.

12. An LED lighting system including a dimmer and a plurality of LED lamps, the dimmer comprising a dimming signal generating circuit and a signal combining processing circuit, wherein:

the dimming signal generating circuit is configured to receive a dimming instruction including a control code, which comprises a square wave of a specific sequence of high/low voltage levels for providing a manner of controlling an LED lamp of the plurality of LED lamps, for the LED lamp to perform control of itself according to the manner of controlling provided by the control code in a received output signal, and the signal combining processing circuit is configured to combine or synthesize a power signal and the dimming instruction to produce the output signal, wherein the power signal comprises a constant direct current (DC), wherein the signal combining processing circuit includes a voltage division circuit and a control circuit, wherein the voltage division circuit has a terminal connected to ground and another terminal acting as a negative terminal of the dimmer; and the control circuit is configured to control voltage division performed by the voltage division circuit or to cause the voltage division circuit to be bypassed by a current and wherein the voltage division circuit comprises a set of diodes connected anode-to-cathode in series, wherein the anode of a first one and the cathode of a last one of the diode set act as an input terminal and an output terminal of the diode set respectively; the control circuit comprises a switch, wherein the switch has a first terminal connected to the output terminal of the diode set, a second terminal connected to the input terminal of the diode set, and a control terminal for connecting to an output terminal of the dimming signal generating circuit; and through the input terminal and output terminal of the switch, the control circuit is configured to be serially connected on a power loop from a power conversion circuit to each of the plurality of LED lamps.

* * * * *